US008516637B2

(12) United States Patent
Karwal et al.

(10) Patent No.: US 8,516,637 B2
(45) Date of Patent: Aug. 27, 2013

(54) PATIENT CARE AND TRANSPORT ASSEMBLY

(75) Inventors: Deepak Raj Karwal, Berkley, MI (US); Gary Ratzlaff Fulkerson, White Lake, MI (US); Gopi Krishna Chowdary Vulava, Okemos, MI (US); Robert Allan Kowalski, Macomb, MI (US)

(73) Assignee: B & R Holdings Company, LLC, Berkley, MI (US)

( * ) Notice: Subject to any disclaimer, the term of this patent is extended or adjusted under 35 U.S.C. 154(b) by 369 days.

(21) Appl. No.: 12/849,197

(22) Filed: Aug. 3, 2010

(65) Prior Publication Data

US 2011/0030142 A1 Feb. 10, 2011

Related U.S. Application Data

(60) Provisional application No. 61/231,450, filed on Aug. 5, 2009.

(51) Int. Cl.
*A47B 7/02* (2006.01)
*A47B 7/00* (2006.01)

(52) U.S. Cl.
USPC ..... 5/608; 5/613; 5/510

(58) Field of Classification Search
USPC ..... 5/607, 608, 610–614, 616, 510
See application file for complete search history.

(56) References Cited

U.S. PATENT DOCUMENTS

| | | | | |
|---|---|---|---|---|
| 1,984,311 | A | 12/1934 | Lamar at al. | |
| 2,322,683 | A | 6/1943 | Costa at al. | |
| 3,138,805 | A | 6/1964 | Piazza | |
| 3,729,751 | A | 5/1973 | Kirkman | |
| 3,900,906 | A * | 8/1975 | Berthelsen | 5/608 |
| 4,717,169 | A | 1/1988 | Shaffer | |
| 4,862,529 | A * | 9/1989 | Peck | 5/611 |
| 4,949,408 | A | 8/1990 | Trkla | |
| 4,974,905 | A | 12/1990 | Davis | |
| 4,982,466 | A * | 1/1991 | Higgins et al. | 5/713 |
| 4,987,620 | A | 1/1991 | Sharon | |
| 5,003,654 | A * | 4/1991 | Vrzalik | 5/715 |
| 5,179,745 | A | 1/1993 | Hebert et al. | |
| 5,333,887 | A | 8/1994 | Luther | |
| 5,370,111 | A | 12/1994 | Reeder et al. | |
| 5,377,371 | A | 1/1995 | Foster | |
| 5,402,544 | A | 4/1995 | Crawford et al. | |
| 5,410,768 | A * | 5/1995 | Manson et al. | 5/609 |
| 5,513,406 | A | 5/1996 | Foster et al. | |

(Continued)

FOREIGN PATENT DOCUMENTS

| | | |
|---|---|---|
| JP | 2001293041 | 10/2001 |
| JP | 2004089666 A | 3/2004 |

(Continued)

*Primary Examiner* — William Kelleher
*Assistant Examiner* — Richard G Davis
(74) *Attorney, Agent, or Firm* — Gifford, Krass, Sprinkle, Anderson & Citkowski, P.C.; Douglas J. McEvoy

(57) ABSTRACT

A mobility assist assembly, consisting of a transportable patient support module including a support surface which is modifiable by at least a plurality of upwardly extending and individually height adjustable and articulate-able posts integrated into a supporting carriage. A power transport module can be docked to the carriage. The patient support surface further includes a plurality of individual height or width adjustable sections. A headboard proximate docking module interfaces with the patient support module and a power assist modules.

16 Claims, 17 Drawing Sheets

(56) References Cited

U.S. PATENT DOCUMENTS

| | | | | |
|---|---|---|---|---|
| 5,555,582 | A | 9/1996 | Jerideau | |
| 5,580,207 | A * | 12/1996 | Kiebooms et al. | 414/495 |
| 5,659,910 | A | 8/1997 | Weiss | |
| 5,680,661 | A | 10/1997 | Foster et al. | |
| 5,715,548 | A | 2/1998 | Weismiller et al. | |
| 5,790,997 | A | 8/1998 | Ruehl | |
| 5,802,640 | A | 9/1998 | Ferrand et al. | |
| 5,860,664 | A | 1/1999 | Smith | |
| 5,996,150 | A | 12/1999 | Blevins et al. | |
| 6,163,903 | A | 12/2000 | Weismiller et al. | |
| 6,272,702 | B1 * | 8/2001 | Uchida et al. | 5/600 |
| 6,282,736 | B1 | 9/2001 | Hand et al. | |
| 6,336,235 | B1 | 1/2002 | Ruehl | |
| 6,353,949 | B1 | 3/2002 | Falbo | |
| 6,360,389 | B1 | 3/2002 | Gallant et al. | |
| 6,367,873 | B1 | 4/2002 | Dorner et al. | |
| 6,374,436 | B1 | 4/2002 | Foster et al. | |
| 6,381,781 | B1 | 5/2002 | Bourgraf et al. | |
| 6,385,801 | B1 | 5/2002 | Watanabe et al. | |
| 6,386,614 | B1 | 5/2002 | Logan | |
| 6,393,641 | B1 | 5/2002 | Hensley | |
| 6,427,270 | B1 | 8/2002 | Blevins et al. | |
| 6,499,163 | B1 | 12/2002 | Stensby | |
| 6,536,056 | B1 | 3/2003 | Woehr et al. | |
| 6,564,409 | B2 | 5/2003 | Metz et al. | |
| 6,584,629 | B2 | 7/2003 | Tsuji et al. | |
| 6,651,279 | B1 | 11/2003 | Muthuvelan | |
| 6,691,346 | B2 * | 2/2004 | Osborne et al. | 5/600 |
| 6,694,548 | B2 | 2/2004 | Foster et al. | |
| 6,725,474 | B2 | 4/2004 | Vogel et al. | |
| 6,725,956 | B1 | 4/2004 | Lemire | |
| 6,772,456 | B2 | 8/2004 | Votel | |
| 6,772,850 | B1 | 8/2004 | Waters et al. | |
| 6,834,402 | B2 | 12/2004 | Hanson et al. | |
| 6,857,147 | B2 | 2/2005 | Somasundaram | |
| 6,862,761 | B2 | 3/2005 | Hand et al. | |
| 6,877,572 | B2 | 4/2005 | Vogel et al. | |
| 6,892,405 | B1 | 5/2005 | Dimitriu et al. | |
| 6,895,715 | B2 | 5/2005 | Gallant et al. | |
| 6,904,631 | B2 | 6/2005 | Vrzalik et al. | |
| 6,951,036 | B2 | 10/2005 | Lemire | |
| 6,957,457 | B2 | 10/2005 | Stryker et al. | |
| 6,957,461 | B2 | 10/2005 | Osborne et al. | |
| 6,978,499 | B2 | 12/2005 | Gallant et al. | |
| 6,978,500 | B2 | 12/2005 | Osborne et al. | |
| 6,978,501 | B2 | 12/2005 | Vrzalik | |
| 6,993,799 | B2 | 2/2006 | Foster et al. | |
| 7,000,272 | B2 | 2/2006 | Allen et al. | |
| 7,003,830 | B2 | 2/2006 | Ito | |
| 7,007,765 | B2 | 3/2006 | Waters et al. | |
| 7,017,208 | B2 | 3/2006 | Weismiller et al. | |
| 7,018,157 | B2 | 3/2006 | Gallant et al. | |
| 7,028,352 | B2 | 4/2006 | Kramer et al. | |
| 7,040,693 | B1 | 5/2006 | Dorner et al. | |
| D527,459 | S | 8/2006 | Gireesh | |
| 7,082,630 | B2 | 8/2006 | Castonguay et al. | |
| 7,083,012 | B2 | 8/2006 | Vogel et al. | |
| 7,089,612 | B2 | 8/2006 | Rocher et al. | |
| 7,090,041 | B2 | 8/2006 | Vogel et al. | |
| 7,107,637 | B2 | 9/2006 | Kuek et al. | |
| 7,125,167 | B2 | 10/2006 | Alakkat | |
| 7,131,154 | B2 | 11/2006 | Davis et al. | |
| 7,195,253 | B2 | 3/2007 | Vogel et al. | |
| 7,219,754 | B2 | 5/2007 | Johnson | |
| 7,234,179 | B2 | 6/2007 | Shaw | |
| 7,237,287 | B2 | 7/2007 | Weismiller et al. | |
| 7,243,386 | B2 | 7/2007 | Gallant et al. | |
| 7,254,850 | B2 | 8/2007 | Newkirk et al. | |
| 7,296,312 | B2 | 11/2007 | Menkedick et al. | |
| 7,305,727 | B2 * | 12/2007 | Horlin | 5/607 |
| 7,340,784 | B2 | 3/2008 | Stryker et al. | |
| 7,346,945 | B2 | 3/2008 | Phillips et al. | |
| 7,363,663 | B2 | 4/2008 | Chambers et al. | |
| 7,392,621 | B2 | 7/2008 | Gallant et al. | |
| 7,419,019 | B1 | 9/2008 | White et al. | |
| 7,426,759 | B2 | 9/2008 | Donaldson | |
| 7,451,505 | B2 | 11/2008 | Johannsen | |
| 7,454,805 | B2 | 11/2008 | Osborne et al. | |
| 7,458,119 | B2 | 12/2008 | Hornbach et al. | |
| 7,472,439 | B2 | 1/2009 | Lemire et al. | |
| 7,472,440 | B2 | 1/2009 | Bartlett et al. | |
| 7,478,446 | B2 | 1/2009 | Sims, Jr. | |
| 7,480,951 | B2 | 1/2009 | Weismiller et al. | |
| 7,481,286 | B2 * | 1/2009 | Ruschke et al. | 180/11 |
| 7,533,742 | B2 | 5/2009 | Johnson et al. | |
| 7,552,733 | B1 | 6/2009 | Schubert, III | |
| 7,559,102 | B1 | 7/2009 | Benzo et al. | |
| 7,631,749 | B2 * | 12/2009 | Somasundaram et al. | 198/468.9 |
| 7,644,458 | B2 * | 1/2010 | Foster et al. | 5/510 |
| 7,757,318 | B2 * | 7/2010 | Poulos et al. | 5/624 |
| 8,165,718 | B2 * | 4/2012 | Ota et al. | 700/259 |
| 2002/0059679 | A1 | 5/2002 | Weismiller et al. | |
| 2003/0000015 | A1 * | 1/2003 | Horlin | 5/600 |
| 2003/0093862 | A1 | 5/2003 | Hanson et al. | |
| 2004/0034936 | A1 | 2/2004 | Welling et al. | |
| 2004/0090333 | A1 | 5/2004 | Wildman et al. | |
| 2004/0128765 | A1 | 7/2004 | Osborne et al. | |
| 2004/0163175 | A1 | 8/2004 | Vogel et al. | |
| 2006/0090261 | A1 | 5/2006 | Vrzalik | |
| 2006/0096029 | A1 | 5/2006 | Osborne et al. | |
| 2006/0112489 | A1 * | 6/2006 | Bobey et al. | 5/655.3 |
| 2006/0191073 | A1 | 8/2006 | Honda | |
| 2006/0279427 | A1 | 12/2006 | Becker et al. | |
| 2007/0113342 | A1 | 5/2007 | Foster et al. | |
| 2007/0157385 | A1 | 7/2007 | Lemire et al. | |
| 2007/0163043 | A1 | 7/2007 | Lemire et al. | |
| 2007/0163045 | A1 | 7/2007 | Becker et al. | |
| 2007/0164871 | A1 | 7/2007 | Dionne et al. | |
| 2007/0169268 | A1 | 7/2007 | Lemire et al. | |
| 2007/0174964 | A1 | 8/2007 | Lemire et al. | |
| 2007/0174965 | A1 * | 8/2007 | Lemire et al. | 5/600 |
| 2008/0005838 | A1 | 1/2008 | Wan Fong et al. | |
| 2008/0035396 | A1 * | 2/2008 | Heimbrock et al. | 180/65.1 |
| 2009/0031498 | A1 | 2/2009 | Girard et al. | |
| 2009/0211026 | A1 * | 8/2009 | Schoff | 5/600 |
| 2010/0005592 | A1 * | 1/2010 | Poulos et al. | 5/618 |

FOREIGN PATENT DOCUMENTS

| | | |
|---|---|---|
| KR | 20010050998 | 6/2001 |
| KR | 100743969 | 7/2007 |
| TW | 262789 B | 10/2006 |

* cited by examiner

PATIENT CARE AND TRANSPORT ASSEMBLY

CROSS-REFERENCE TO RELATED APPLICATIONS

This application claims the benefit of U.S. Provisional Application No. 61/231,450 filed on Aug. 5, 2009 and entitled Mobile Wheelchair with Integrated Bed System.

FIELD OF THE INVENTION

The present invention discloses a versatile bed system incorporating a first convertible wheelchair/bed module, a second headboard/docking station module and a third mobility assist power drive module. The mobile assist system is particularly suited for general transport use within a hospital or like setting and provides a series of features, including a four vertical post drive system with motions features that provide ease of use and drastically reduce the risks associated with handling of patients by caregivers.

BACKGROUND OF THE INVENTION

The prior art is well documented with examples of wheelable bed and chair transports, such as for use in hospitals or other medical care giving facilities and in order to efficiently transport patients. A shortcoming of the existing art has been the ability to incorporate the features of powered transport, bed/char convert-ability and adjustability for moving patients, along with providing for powered recharge and information gathering, retention, monitoring and sync-sharing of patient data (including vital statistics) between the patient transport and other supporting modules.

SUMMARY OF THE INVENTION

The present invention discloses a mobility assist assembly including a transportable (such as wheeled) patient support module exhibiting an articulating and multi-repositionable support surface which is integrated with and supported upon a plurality of upwardly extending and individually height adjustable and articulate-able posts associated with an underside carriage. The patient support surface may further include a plurality of individual height or width adjustable sections manipulated by the individually adjustable underside supporting posts. A power support/transport module can be docked with the carriage. A headboard proximate docking module interfaces with the combined patient support and power assist/surface reconfigurable modules and provides any of increasing displaceable side portions for extending a width of the patient support surface, recharging of the power module, and/or communicating medical and other information to onboard processor capabilities incorporated into the patient transport module.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

As will be described in furthering detail with reference to each of the illustrations, the present invention discloses a versatile patient support system, such as for use with hospitals, nursing/patient care facilities and other applications. The versatile transport system incorporates a variety of motion and articulation features that provide ease of use and drastically reduce the risks associated with handling of patients by caregivers.

Beyond that disclosed in the succeeding embodiments, it is also contemplated that other variants of the invention can be developed for personal/home use or other medical and non-medical applications. As will also be illustrated in succeeding detail, the invention incorporates three distinct modules (which are further defined to include specific sub-assemblies and components which collectively defining the overall patient care and transport assembly), and such as which can work in either dependent or independent fashion relative to each other with varying benefits realized when the components or modules are integrated together as a system.

Figure 18:
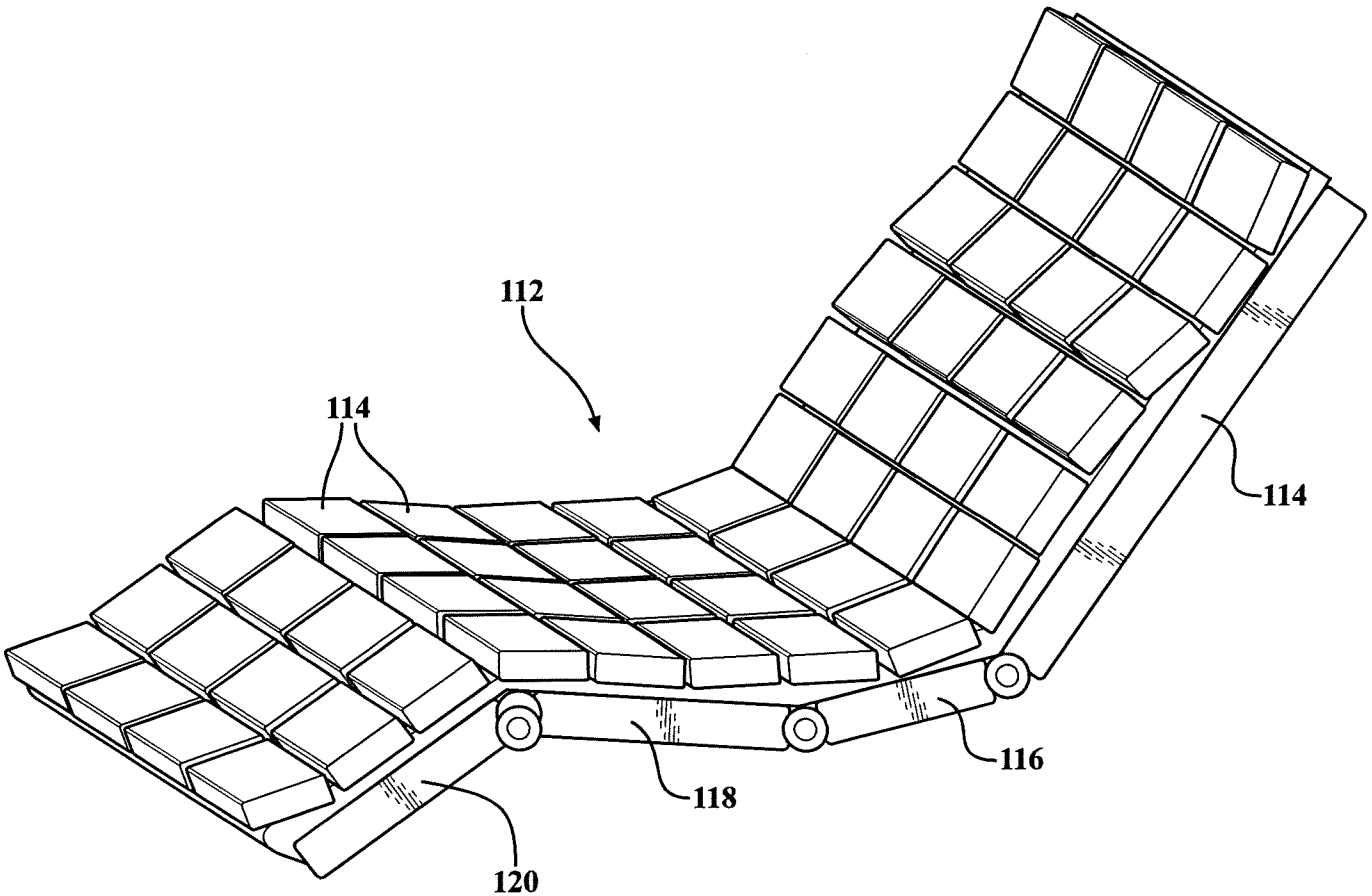
FIG. 18 is an illustration of a further potential configuration of bed support surface and which incorporates a plurality of grid-type surface segments constructed of individualized deformation supporting (e.g. gel) pockets, such as which are further attached to an articulating surface and which cooperate with patient supported pressure points.

Prior to engaging in a successive description of each of the illustrated embodiments, a general description will be provided of the main components or modules associated with the patient care and transport system and which provide the desired versatility of use ranging between a static hospital bed-type configuration and any type of detached bed/wheelchair transport and reposition configuration. The first module incorporates an articulating and patient supporting/reconfigurable assembly (generally referenced by first transport module at 10 in FIGS. 1 and 2) and, as will be described in reference to the various illustrations disclosed herein, exhibits a planar and inter-articulating frame supporting thereupon a patient support surface (such as most commonly referred to as a mattress but understood to include any cushioned or segmented support surface, see as shown in FIG. 18, providing the ability to interarticulate individual sections relative to one another and without damage thereto), which provides several distinct articulations and extensions to accommodate various needs of the patient and to provide assistance to the caregiver. The articulations include without limitation:

- Height adjustment
- Longitudinal tilt (front and back)
- Lateral tilt (left and right) (unique in the US market)
- Head/torso tilt (above the horizontal)
- Thigh tilt (above the horizontal)
- Knee tilt (below the horizontal)
- Leg extension (to accommodate various user height needs
- Retractable bed frame to reduce foot print of bed in wheelchair mode (unique to this device)

The second module is a stationary "docking" or headboard proximate station (see as further generally referenced at 12 and which, while wheel supported as shown is considered stationary as it is detachable from the patient support module during transport of the latter) such as further being located within the destination (hospital) room for the patient. The design of the headboard module 12 is such that it enhances the functionality of the patient transport (wheelchair/bed) system. As will be illustrated, the patient support subassembly 10 docks to the headboard module 12, such as both to extend its width by mechanical means, for charging onboard batteries, and/or communicating other information to any processor capability incorporated into the patient support module located on the underside frame carriage associated with the mobility assist device.

Figure 1:
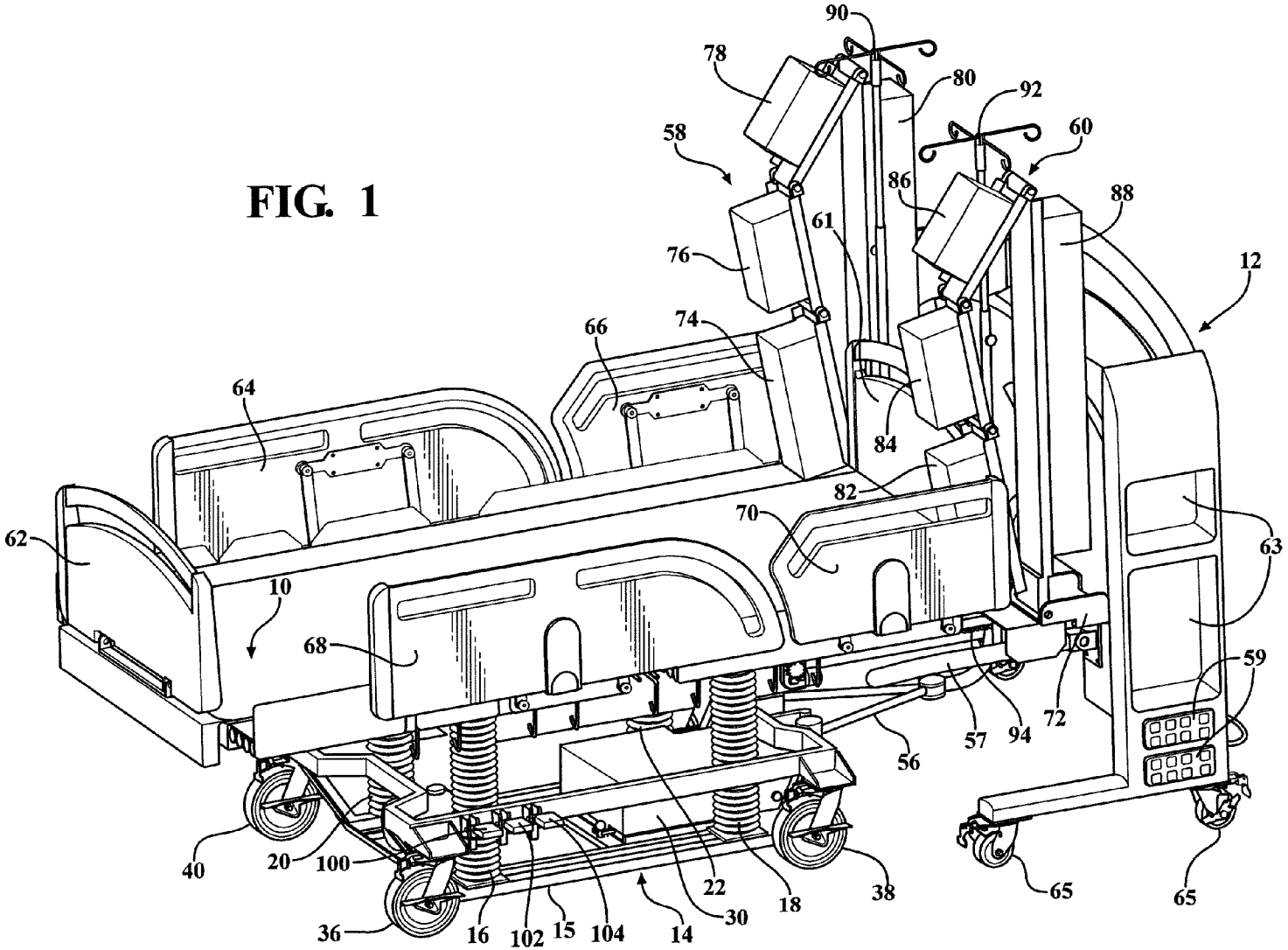
FIG. 1 is a perspective illustration of a convertible wheelchair/bed in docking engagement with the headboard station module according to one possible arrangement of the present invention and by which a pair of laterally positioned support surface width extension components are displaced in a combined pivotally and elongated fashion between upward retracted downward extending/overlapping/aligning/lineally extending positions along opposite sides of a central support surface.

Among the features provided by the docking headboard module 12 are included (again without limitation) the following:

- Storage and shelving for patient convenience
- Medical device containment
- Width extensions for wheelchair (bed configuration)
- Various power outlets (12V DC, 24V DC, 110V AC 60 hz, 230V AC 50 hz)
- Casters for limited mobility for placement in the room and room maintenance The third module is a mobility assist power drive system, see as generally illustrated at 14 which includes a wheeled carriage or four sided sub-frame 15 upon which are supported and from which upwardly extend a plurality of four individual telescoping supports or pedestals 16, 18, 20 and 22. The pedestal supports depicted at 16-22 exhibit outer accordion sleeve or boot covers and, although not shown, are further envisioned to enclose such as individual telescoping cylinders and which, and representatively shown in FIG. 1, are secured at lower ends to perimeter frame locations of the mobile assist carriage while upper ends (depicted at 24, 26 and 28 for selected supports 16, 18, 20 in FIGS. 6 and 7) incorporate universal articulating connections (such as a ball and receiver type joint or other modified swivels allowing for multi-dimensional articulation) engaging underside locations of the associated subframe (including inter-articulating portions) associated with the patient support surface 10 and which is further identified at 29 in FIG. 6.

Figure 6:
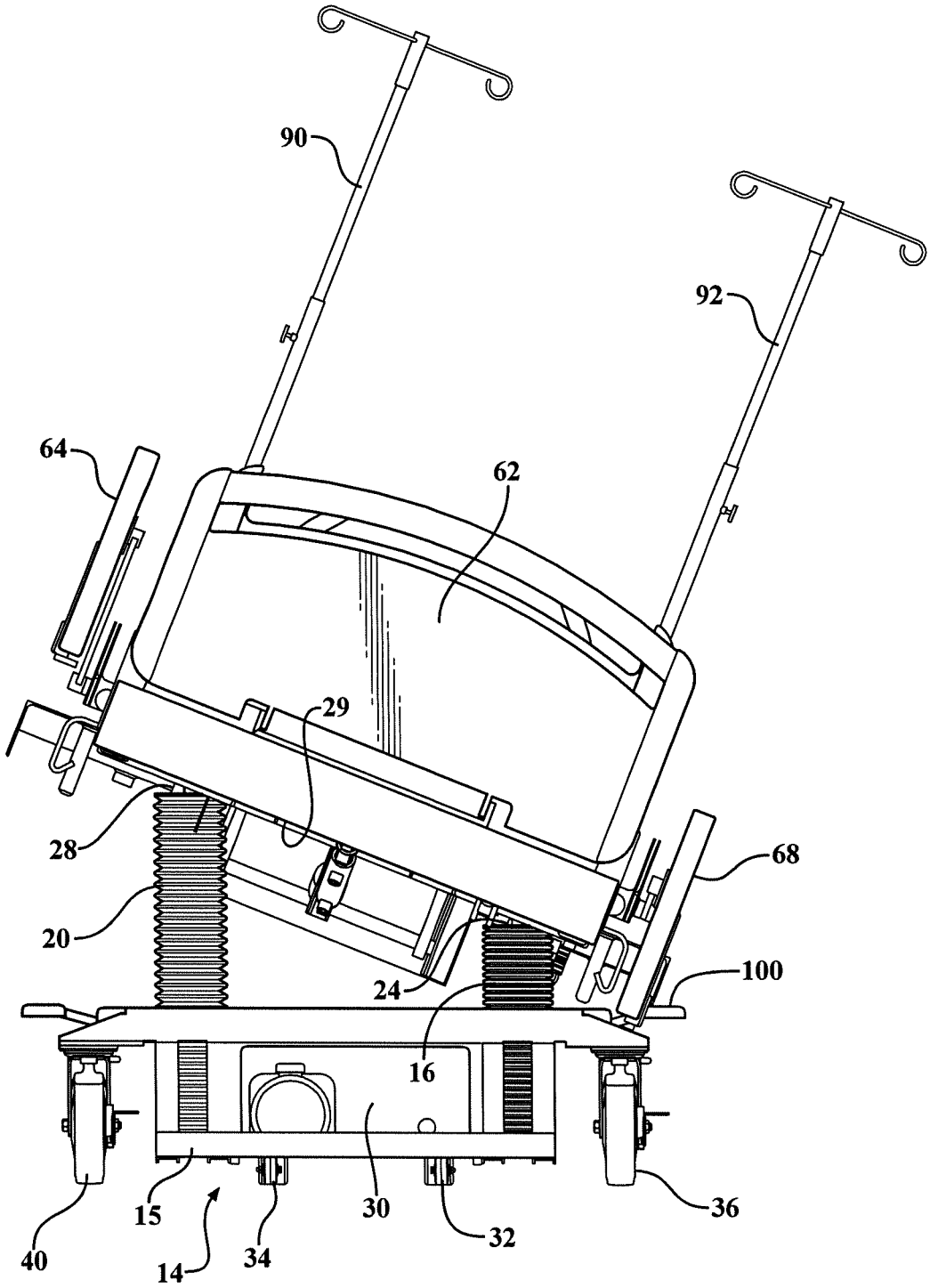
FIG. 6 is a front end view of the mobility assist device in FIG. 5 and illustrating from another vantage point the features of the underside pivoting/telescoping support established by the plurality of length adjustable/displaceable posts.
Figure 12:
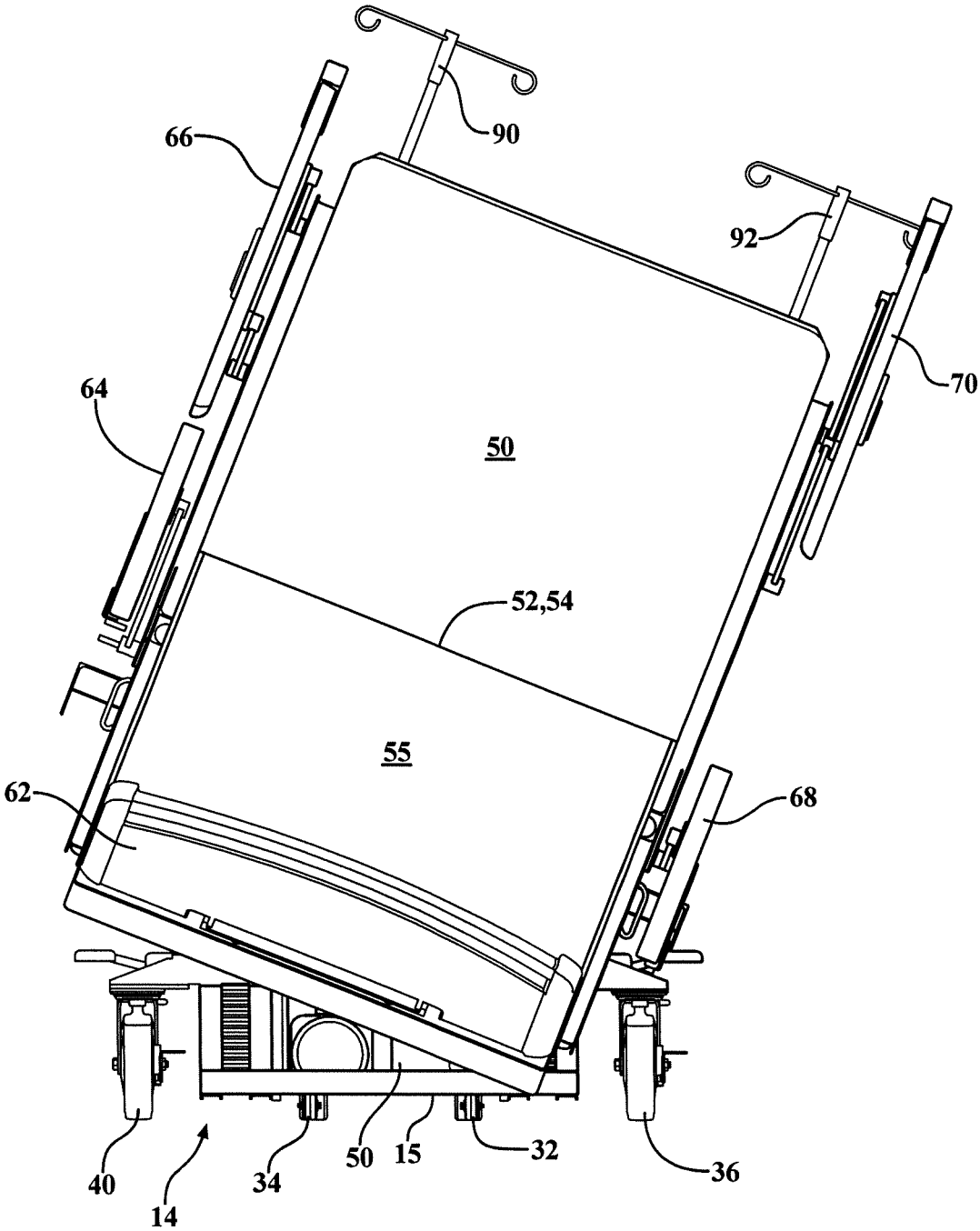
FIG. 12 is a forward looking view of a wheelchair lateral tilt position made possible according to the present invention.

A power drive component 30 is integrated with or releasably attachable to a generally centralized and rear location of the underside carriage frame defining the module 14. The drive component 30 houses such as an on-board rechargeable battery (or other integrated power source) for generating a power output drive, via such as a suitable gear and/or shaft arrangement) to initial drive wheels 32 and 34 (see as best shown in FIGS. 6 and 12) positioned in underside ground engaging and proximate fashion to the drive component 30.

The driving force exerted by the powered wheels 32 and 34 is transferred to the existing wheeled supports or castors 36, 38, 40 and 42 arranged at the four corners of the carriage (such as similar to existing shopping cart style wheels) and in order to provide power assistance for easy mobility of the patient support surface 10. It is also envisioned that the power drive unit 30 with output drive wheels 32 and 34 can be removed while maintaining manual propelling of the underside carriage 15 and surrounding wheels 36, 38, 40 and 42.

As will be further described and illustrated, the power assist drive unit provides the mobility assist module with total mobility on flat floors to assist in the transportation of the patient. It is further envisioned that the power assist drive unit will incorporate "tank" style steering with motor breaking as well as the wheelchair having mechanical brakes on its casters. As previously described, the mobility assist module may include remote battery charging.

As will be further described with reference to the several variants illustrated and described herein, the four multiple positioning vertical telescoping posts or supports 16, 18, 20 and 22 can be adjusted to an infinite number of articulated positions that are programmable via a portable processor unit that is built into the patient support carriage using battery dependent electronics to acquire various desired positions. The four telescoping posts accomplish their main articulations such as tilting (fore, aft, left, right) with the aid of any combination of hydraulics, electro hydraulics, electro magnetism, pneumatics, electric motors, cable or chain drives, rack and pinion, gears, belts and the like and which are built into the carriage drive 14 and patient support 10 modules.

The ability of the four support posts 16, 18, 20 and 22 to independently operate and adjust, such as according to built in servo actuated protocols incorporated into the carriage and drive module 14, provides unique articulations in both bed and wheelchair modes as will be subsequently described and depicted. Based on such as the four post mechanism illustrated and described herein, a family of products can be developed as additional features and offshoots of the proposed invention that include, but are not limited to: a commode wheelchair, stretcher, gurney, surgical table/bed, infant/pediatric motion bed, and articulating manufacturing assembly tables, etc.

Additional features of the frame include articulating surfaces that raise and lower the angles of the associated back and leg supports. The articulating surfaces incorporated into the mobility assist device are further understood to exhibit depressions, such as shown in spaced apart and widthwise extending fashion at 44, 46 and 48 in FIG. 2 in the patient support surface 10 both control and retain the mobile assist assembly in varying shaped configurations.

In combination, the posts and articulating surfaces are able to achieve several pre-programmed positions, including such as: chair position, assisted standing position, bed position (flat), sitting position, sitting position with elevated knees, CPR position, Trendelenburg and reverse Trendelenburg positions, and tilt right/left of no less than 15°.

As will be further described throughout the several illustrations below, the patient support surface as previously described is separated into any number, such as three shown, of interconnected and inter-articulating portions, these including an upper torso supporting portion 50, an intermediate and midsection/buttocks supporting portion 52 and a two part leg supporting portion 54 and 55 (see FIGS. 2, 8 and 9). As previously indicated, it is further envisioned that the patient support surface can exhibit alternative constructions (one example of which is subsequently described in reference to the variant of FIG. 18) beyond that shown. Furthermore, the leg section 54 depicts a pair of inter-articulating subsections, again at 54 and 55 and corresponding to the upper and lower legs of the patient supported thereupon, and which may also be adjusted/lengthened such as for taller patents.

In use, bed position can be achieved in any number of unique ways including when patient convenience is desirable the mobile bed/chair can be "docked" to a headboard station that includes components (again shown in FIGS. 1 and 3) that expand its width into a bed configuration to a distance of no less than six inches on either side. This configuration can allow for additional options and conveniences for a longer term patient or a more "home like" use.

Docking of the mobility assist module is done by first converting the module 10 from wheelchair to bed configuration, resulting in a flat and horizontal position. The converted bed is then placed in an open area, at which point underside located brakes associated with the carriage wheels 36-44 are set.

Figure 2:
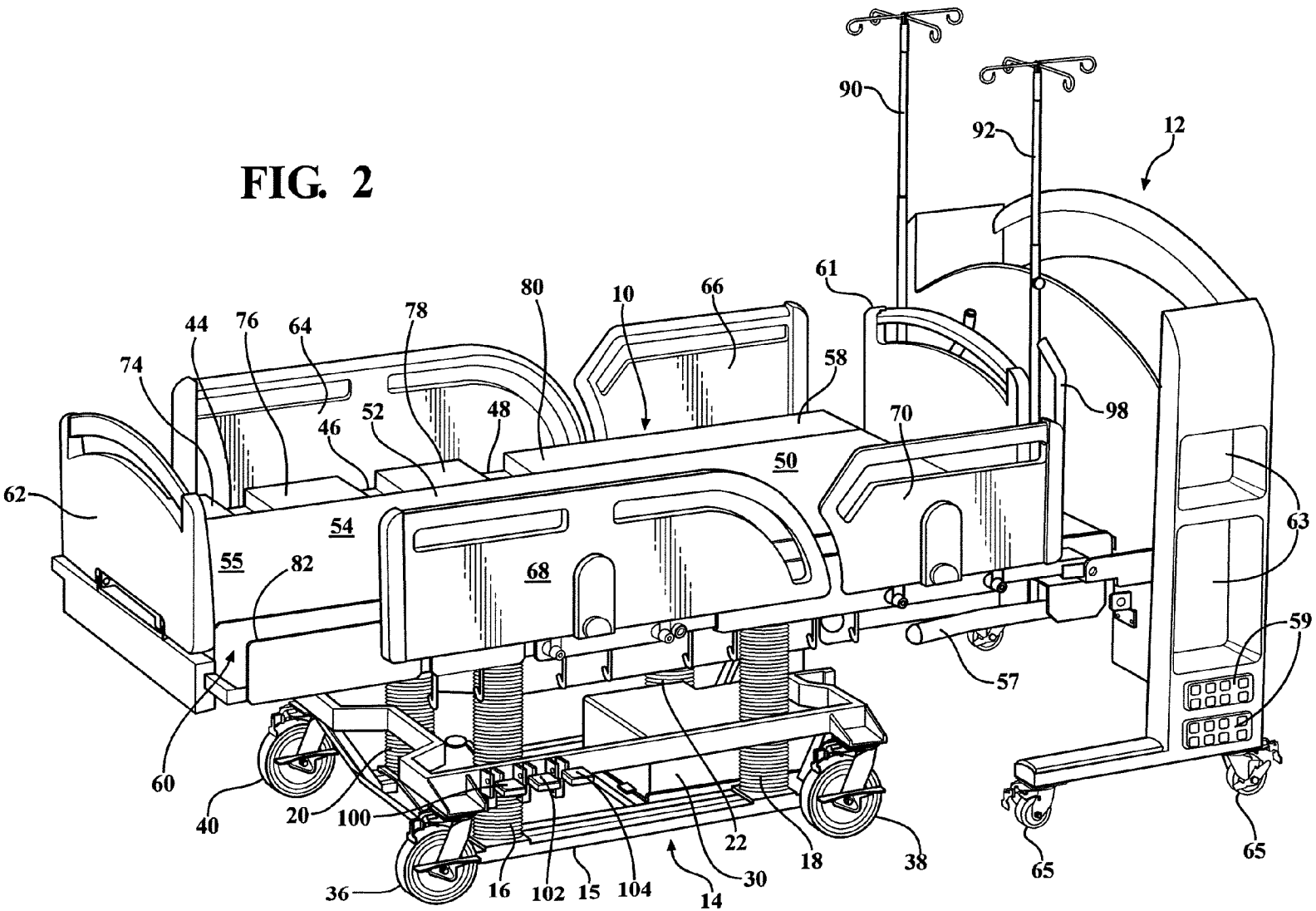
FIG. 2 is an illustration of a design similar to that depicted in FIG. 1 and in which the lateral extension components are fully engaged in seating fashion along the opposite sides of the main patient support component.
Figure 3:
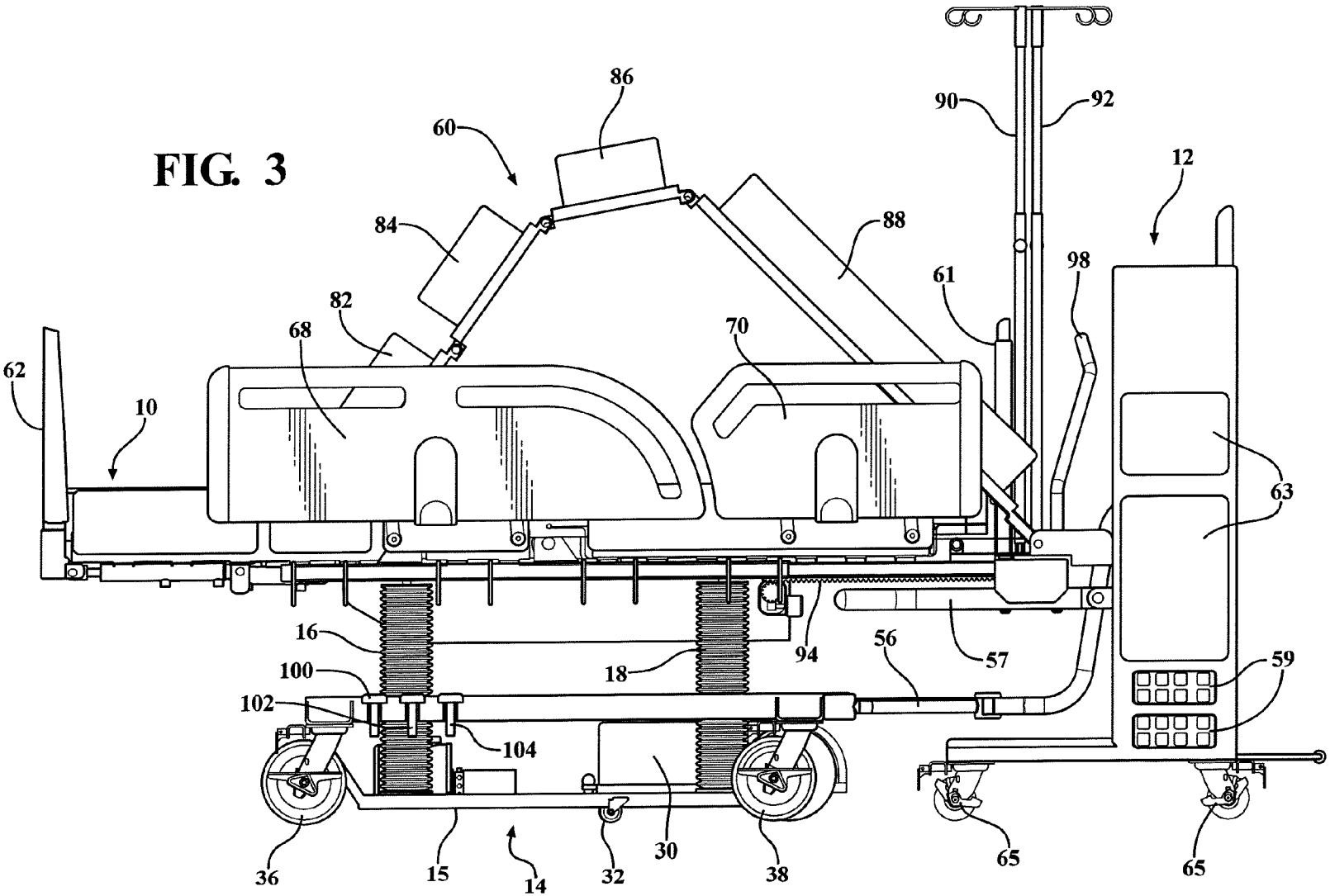
FIG. 3 illustrates an intermediate extension position of the extension components shown in FIG. 1 extending across the patient support surface in an extended position.

At this point, the headboard docking station 14 is then maneuvered to the head of the mobile assist subassembly, until the guides can assist in positioning the headboard at the drawing point of the mobility assist module (see again interface arrangement of FIGS. 1-3). An associated winch 56 (FIGS. 1 and 3) is then activated to pull the headboard 14 into a latching position to the assist module 10 and underlying power transport module 12.

The docked mobility assist module and headboard can then be positioned in the room as desired. It is further envisioned that the headboard module 12 will house the capture, winching and latching mechanisms (see again winch 56 assembly in combination with engaging/draw down bar 57 as again illustrated in FIG. 1) for positioning and retaining the mobility assist device 10 in engagement with the headboard module 12. It further again understood that the headboard module 12 can include additional power sources (at 59) for battery charging of such as the power source 30 associated with the carriage supported drive module 12, castors (at 65) for limited mobility, and storage recesses (at 63) for holding personal items as well as limited medical devices and the ability to communicate any information to mobile processor components built into the main transport component 10.

As further illustrated in FIGS. 1 and 3, an associated width of the patient support surface can be expanded in any of a number of potential ways, such as by the lateral installation of additional width expanding components 58 and 60 that are contained on a frame structure on either side of the patient assist module, once docked. The extension portions 58 and 60 as shown are supported in pivotally and extensible fashion from the headboard module 12 and are further understood as capable of positioned manually or with the assistance of electric motors. Once positioned, the extensions work in unison with articulating portions associated with the mobility assist module as shown in the succeeding illustrations.

In a further desired application, such when a totally mobile configuration is more useful, the docking to a headboard can be forgone and the convertible wheelchair/bed can be employed as a self contained device, further such that its support surface and safety side rails are expand to a distance of no less than six inches on either side and in order to establish a widened configuration. The expansion of the patient support surface can be achieved by inflation according to any of a number of possible application, one non-limiting example of which incorporates any plurality of elongated cells, utilizing a type of gas such as, but not limited to, air or otherwise expanded in a hydraulic fashion, such as with the use of any type of liquid including water.

Safety rails associated with the patent transport assembly can likewise be expanded by the incorporation of such as telescoping surfaces, and can be either manually or power (through the assistance of electric motors) operated. Although not shown, it is further envisioned that the safety side rails assist the inflatable portions of the support surface to expand outward and to collapse back to the stowed position.

The features of the present invention include, but not limited to each of power or manual operation, power assist drive system, headboard docking system, expandable support surface system, height adjustment, longitudinal tilt, lateral tilt, bed configuration, expandable bed surfaces, chair configuration, CPR position, Trendelenburg and reverse Trendelenburg positions, head/torso tilt, thigh tilt, knee tilt, leg extension, retractable frame, and in-room docking station.

Other features of the proposed invention enhance and complement each other as well as add convenience to both patient and caregiver. These include without limitation:

- Intuitive and user friendly controls
- Quick release safety foot lever for CPR
- Foot lever for quick bed lowering
- Manual foot lever for operation of articulations and positioning of the wheelchair/bed (plug-in power not required)
- Power operation of articulations and positioning of wheelchair/bed (plug-in power required)
- Embedded weigh scale Versatile safety side rails with embedded tray, can be used for food service, reading, laptop support, and work table for caregivers Docking mobility assist power drive system to provide assistance for patent mobility-steerable On-board collapsible IV poles Braking system In view of the above, and referring again to FIG. 1, a perspective illustration is shown of a convertible patient support surface (such as between a wheelchair and bed) 10 in docking engagement with the headboard station module 12 according to one possible arrangement of the present invention.

A headboard 61 is linearly adjustably supported at a forward end of the support and transport assembly 10, with a convertible footboard 62 positioned at an opposite end and associated and likewise inter-articulating pairs of side rails 64 & 66 and 68 & 70 along opposite sides which, as will be described, are articulated into a number of frame supporting configurations associated with bed and wheelchair mode operation. The patient support surface again generally referenced by such as individually articulating portions 50, 52, 54 and 55 is associated with the first module 10 and, as described herein, can be provided according to any of a number of different articulating configurations, such as for supporting the upper and lower legs, midsection, shoulders and neck in any of a flat (FIGS. 1-7), intermediate (FIGS. 8-11) or wheelchair (FIGS. 12-17) modes.

As previously described, the patient support surface can also include the laterally expandable side portions 58 and 60 associated with each of opposite sides, these being pivotally connected to the headboard component 12 via such as brackets (one selected bracket 72 being illustrated in FIG. 1 associated with selected width increasing portion 60) for providing desired width expansion of the patient seating surface. As previously described, the laterally positioned support surface width extension components 58 and 60 (best shown in FIG. 1) each exhibit a plurality of hingedly interconnected portions 74, 76, 78, 80 and 82, 84, 86, 88 (each of these exhibiting a solid planar base from which projects a cushioned body) which are again displaced in a combined pivotally and elongated fashion between upward retracted (FIG. 1), and downward extending/overlapping/aligning/lineally extending (FIGS. 3 and 4) positions along opposite sides of a central support surface.

Figure 10:
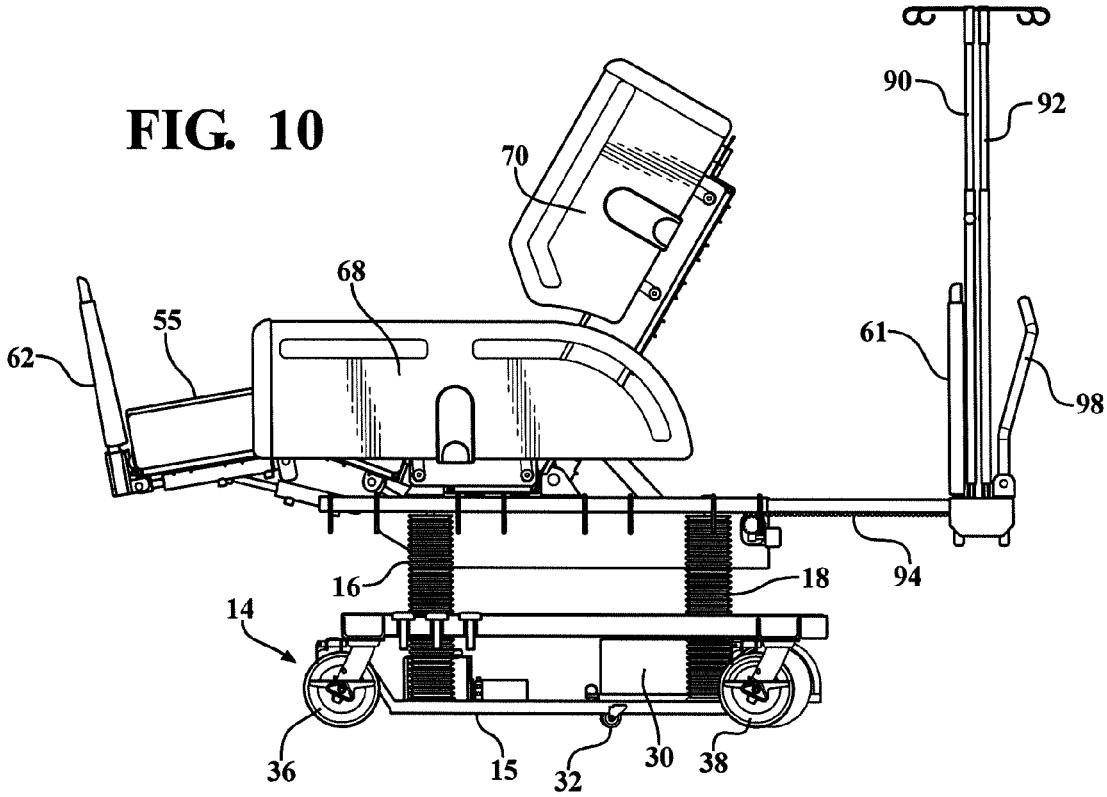
FIG. 10 is a side view of FIG. 8.
Figure 11:
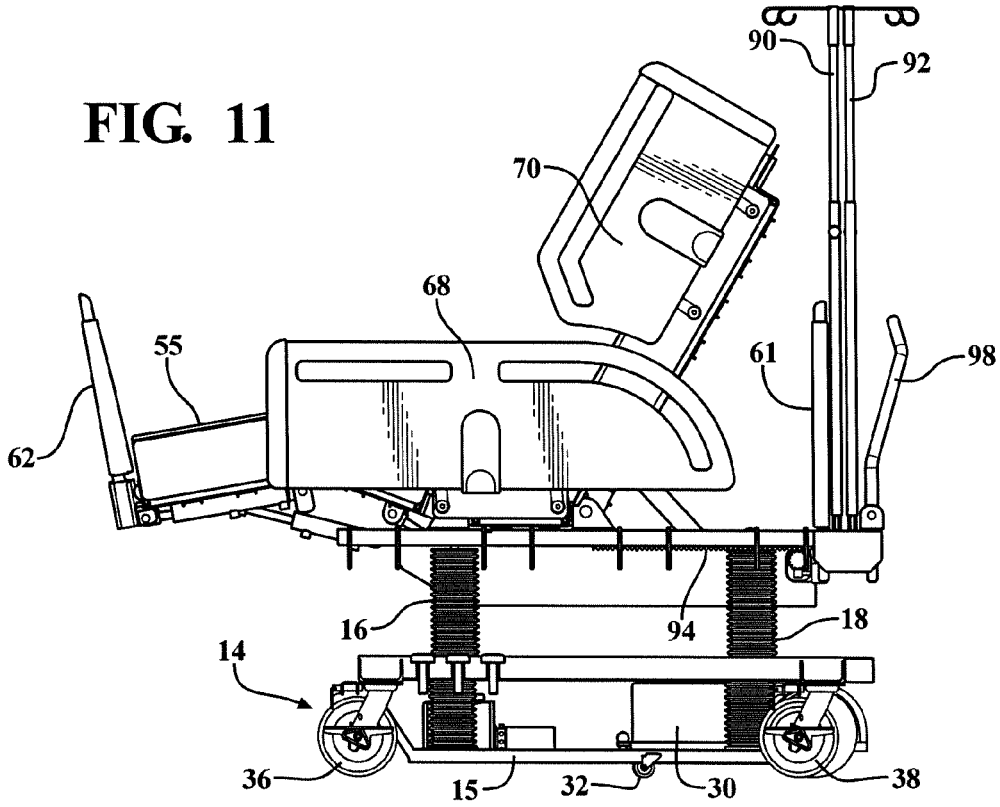
FIG. 11 is a side view of FIG. 9.

Additional features include a pair of telescoping IV support poles 90 and 92, associated with the headboard portion 61 of the first transport module 10. The headboard 61 is again distinguished from the stationary or docking module 12 (also loosely termed a headboard module) in that the headboard 61 is a component of the module 10 which detaches therewith. Linear adjustability of the headboard 61 (such as depicted in FIGS. 10 and 11 and which is desirable upon removing the patient support module 10 and supporting transport module 14 from the headboard module 12 and converting to a wheelchair mode) along with the IV support poles 90 and 92 is accomplished via horizontal and teethed support bars 94 and 96 (FIG. 8) in association with a proximate located push/pull steering handle 98 for facilitating adjustment of the incorporated headboard 61.

Addressing the illustrations in succession, FIG. 1 again shows the mobility assist device (including patient support module 10 and underlying carriage support and powered drive module 14) in docked engagement with the headboard module 12. As previously described, the linear extending and lateral seating width extending support surface components 58 and 60 are optional features associated with the headboard module 12 and which, when docked with the patient supporting mobility assist module 10, serve to provide additional width such as to function as a convertible style bed.

As also previously depicted at 74-80 and 82-88 respectively, the length extending components 58 and 60 are each articulated and segmented to facilitate subsequent adjustment of the support surface to any of a number of different configurations while docked to the headboard module 12. Additional features include the provision of a series of foot pedals 100, 102 and 104 which can be connected to the powered servos which actuate to manipulate the telescoping posts 16, 18, 20 and 22, such as in selected paired fashion, and in order to achieve the desired fore, aft or side-to-side pivoting the patient support surface.

In this manner, the arrangement of integrated servos or cylinders (not shown) associated with the joined patient transport 10 and drive 14 modules are such that the telescoping supports can be either fluid actuated (hydraulic or pneumatic) or, in certain further instances, a threaded screw drive with a rotating/slip collar affixed to the underside of the patient support frame can be employed in order to facilitate pivoting motion. As also previously described, the posts 16, 18, 20 and 22 can further be reciprocally driven, such as in pairs and by the associated power servo mechanisms, in order to achieve any desired form of continually reciprocating (e.g. therapeutic) motion.

The four post cylinders as disclosed, are tilt-able and/or height adjustable in any of lateral, longitudinal or combined fashion in order to operate as any of a hospital bed, wheelchair, gurney, surgical table, work table, or other suitable configuration. As also previously described, associated servo controlled motors communicating with the vertical posts can also provide any desired programmed rocking or reciprocating motion, such as is desired in use with a therapeutic protocol for the patient.

Referring now to FIG. 2, an illustration is shown in which the lateral extension components are fully extended in horizontal and lengthwise manner in engagement along the opposite side edges of the main support surface component (see again as depicted by inter-articulating sections including upper torso section 50, buttock supporting section 52 and leg supporting sections 54 and 55. The present inventions further contemplate either the provision or absence of the support surface width extension components 58 and 60 without departing from its scope. The patient support components (including 50, 52, 54, 55, 58 and 60) can further be widthwise recessed or scalloped as shown and to facilitate ease of inter-angular adjustment without damage thereto.

Figure 4:
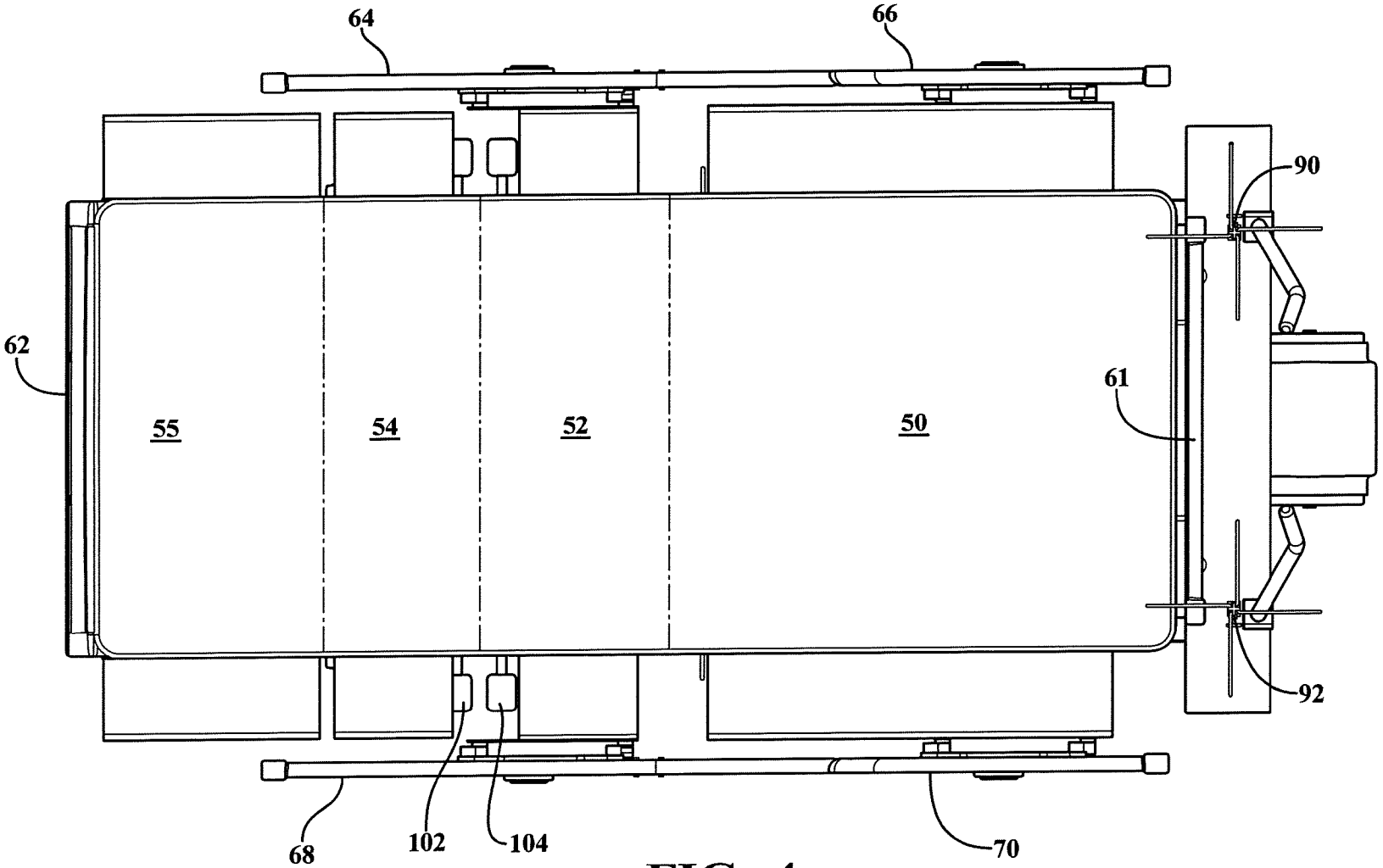
FIG. 4 is a top view of the mobility assist device of FIG. 3 (convertible wheelchair/bed) and without the headboard docking station.

FIG. 3 illustrates an intermediate extension position of the extension components 58 and 60 shown in FIG. 1 extending across the patient support surface (again support portions 50, 52, 54 and 55) in an extended position. FIG. 4 is a succeeding top view of the mobility assist device of FIG. 3 (convertible wheelchair/bed), upon being removed from the headboard docking station module 12

Figure 5:
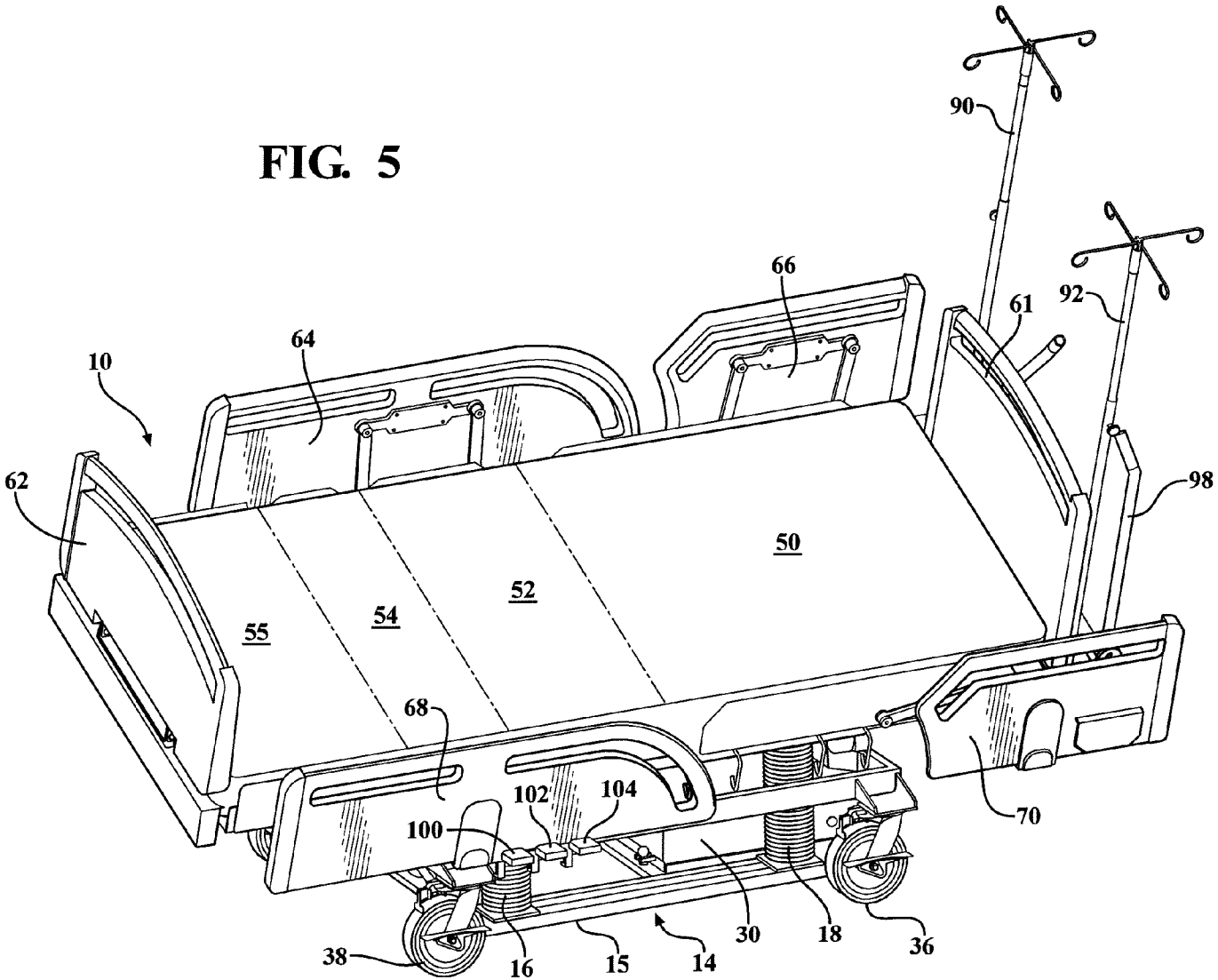
FIG. 5 is a perspective view of the mobility assist device such as depicted in FIG. 2 and further illustrating the pivoting nature of the patient support surface upon the individually telescopic support posts.

Proceeding to FIG. 5, a perspective view is shown of the mobility assist device such as depicted in FIG. 2 and further illustrating the pivoting nature of the patient support surface (again generally depicted by interconnected support sub-portions 50, 52, 54 and 55) upon the individually telescopic support posts 16, 18, 20 and 22. FIG. 6 is a front end view of the mobility assist device in FIG. 5 and illustrating from another vantage point the features of the underside pivoting/telescoping support established by the plurality of length adjustable/displaceable posts 16-22. Also referenced in FIG. 5 is the manner in which the side rail supports can be pivotally displaced between standard bed position (see as further depicted by rail 66) to a rear position (as shown by 70) and in order to subsequently permit the mobility assist assembly to be pivoted into the wheelchair and pseudo-wheelchair modes.

Figure 7:
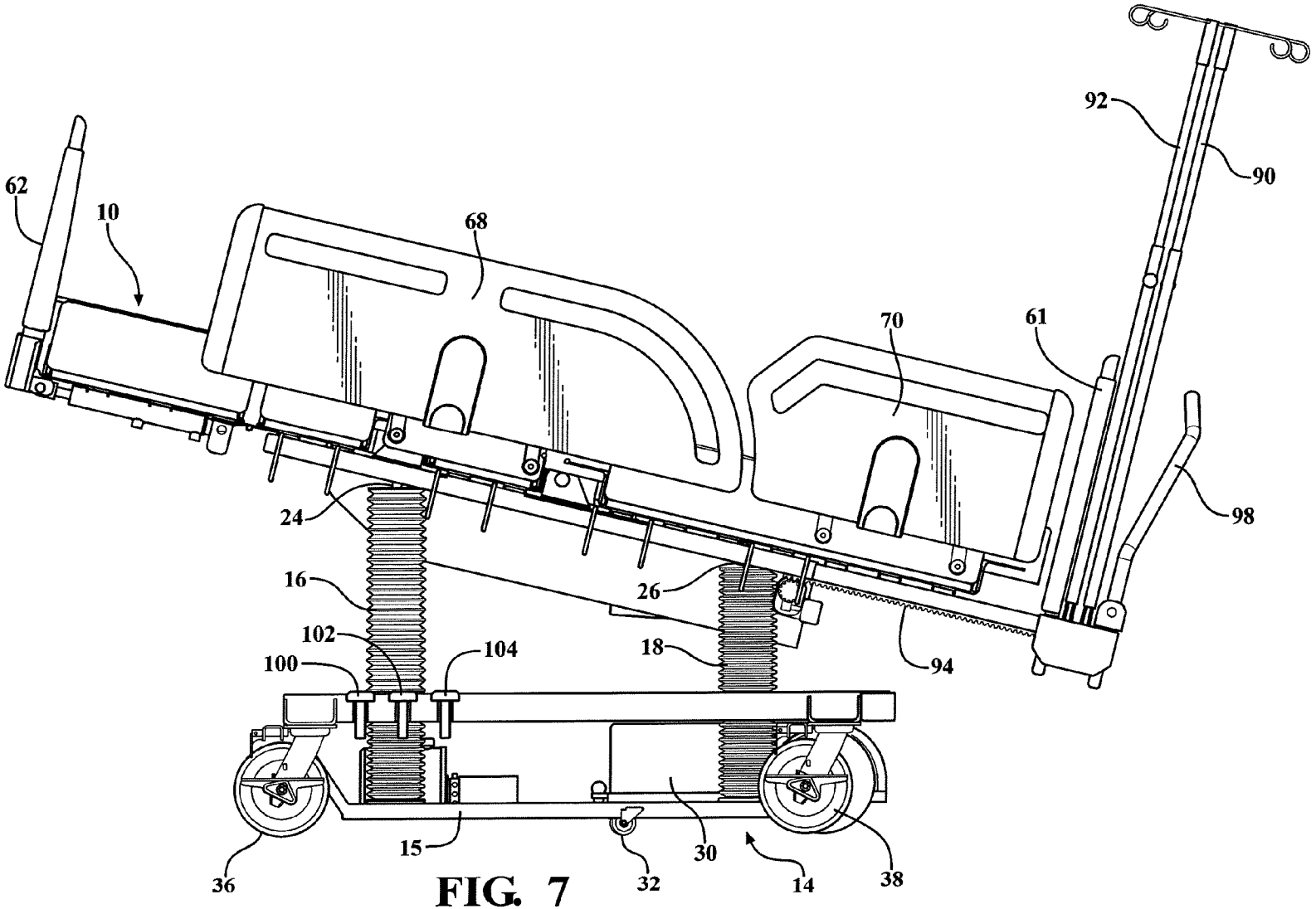
FIG. 7 is a side plan view of the mobility assist device depicted in FIG. 5 and further showing the plurality of underside supporting and telescoping posts in a further rearward tilt configuration associated with the patient support surface.

FIG. 6 further provides a good vantage point for illustrating the underside supported and fore/aft/side to side pivoting aspects of the patient support surface via the combination of the inter-length adjustable (telescoping) posts 16-22 and the associated powered mechanism (again including powered servos and the like which are not clearly shown but which are understood as capable of being integrated into the individual telescoping posts 16-22) for actuating the telescoping posts singularly or in concert in order to achieve any desired dynamic reconfiguration of the support surface. FIG. 7 is a side plan view of the mobility assist device depicted in FIG. 5 and further showing the plurality of underside supporting and telescoping posts in a further rearward tilt configuration associated with the patient support surface.

Figure 8:
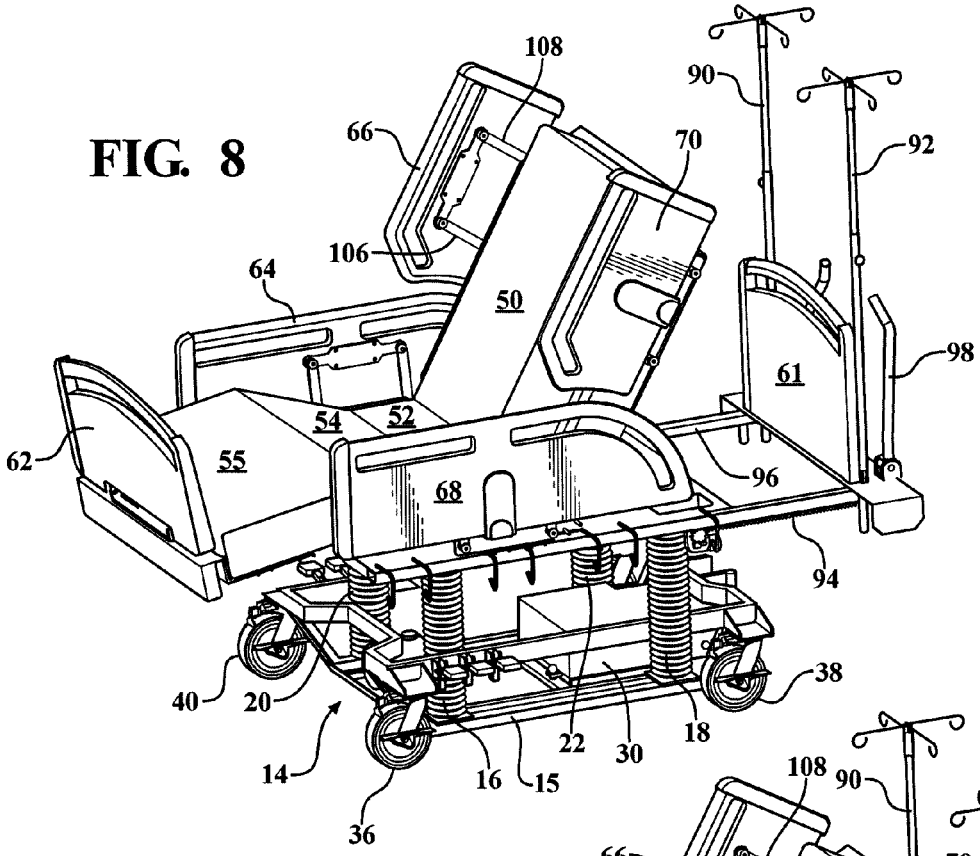
FIG. 8 is an illustration of the mobile assembly and by which the articulating patient support surface is reconfigured to an intermediate converted position between bed and wheelchair configurations and by which the upper torso portion is upwardly angled relative to midsection and leg portions.

Proceeding to FIGS. 8 and 10, a pair of perspective and side view illustrations are provided of the detached mobile assembly and by which the articulating patient support surface (portions 50, 52 and 54) is reconfigured to an intermediate converted position between bed and wheelchair configurations, and by which the upper torso portion 50 is upwardly angled relative to midsection 52 and leg 54, 55 portions. FIGS. 9 and 11 are succeeding perspective and side view illustrations to that shown in FIGS. 8 and 10 and in which a linearly displaceable headboard 61 is retracted to a position proximate the upwardly angled torso portion 50 of the patient support.

The configuration of the side rails are further such that the opposing contours associated with upper pairs 66 and 70 relative to the lower pairs 64 and 68, permit the back portion to pivot upwardly in the manner shown. The individual side rails again are each connected to the sides of the mobility assist device via pairs of pivot brackets (see as depicted in FIG. 8 for rail 66 by pair of pivot brackets 106 and 108) and which facilitate the ability to pivotally displace and/or lower any of the rails 64, 66, 68 and 70 to facilitate either repositioning between bed and wheelchair modes, as well as to facilitate ingress and egress of the patient.

FIG. 12 is a forward looking view of a lateral tilt position accomplished following conversion to the wheelchair configuration and which generally corresponds to a similar tilt configuration achieved in the bed configuration of FIGS. 5 and 6. This includes downwardly displacing the leg support portions 54 and 55 and associated footboard 62 (such as via an underside bracket illustrated at 110 in each of FIGS. 14-16 established between the leg supporting portions 54, 55) following which the arrangement of servo-actuated telescoping supports 16, 18, 20 and 22, as again actuated by selected foot pedals 100, 102, and 104, displaces the patient support surface according to any of fore, aft or side pivoting positions.

Figure 9:
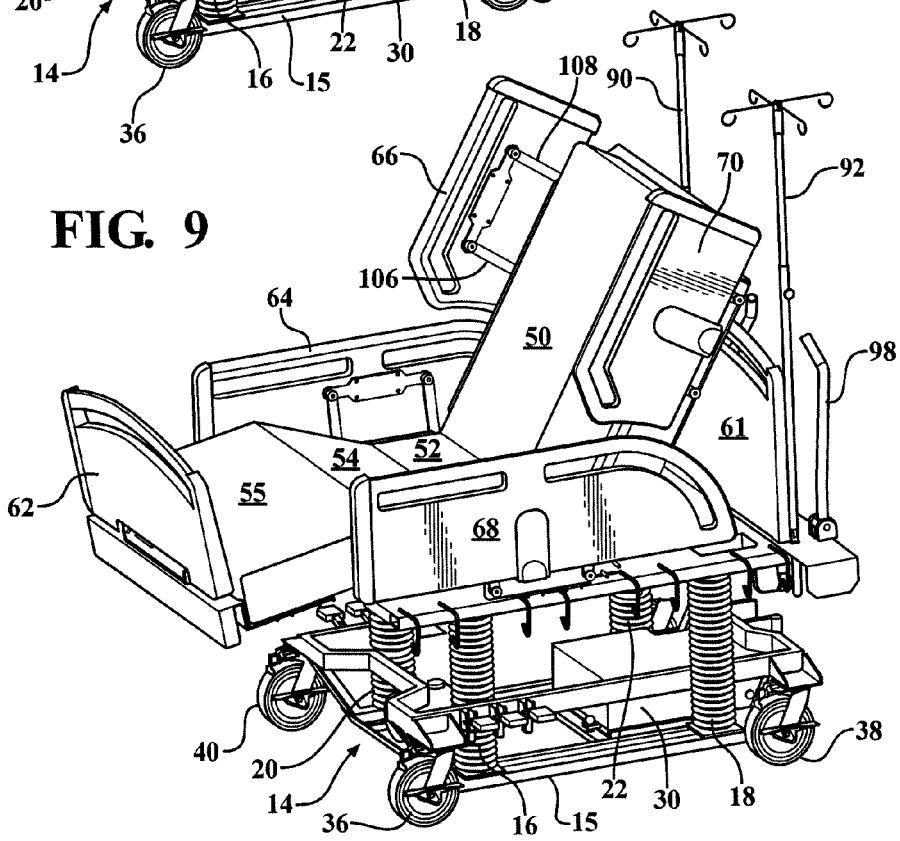
FIG. 9 is a succeeding illustration to that shown in FIG. 8 and in which a linearly displaceable headboard component is retracted to a position proximate the upwardly angled torso portion.
Figure 13:
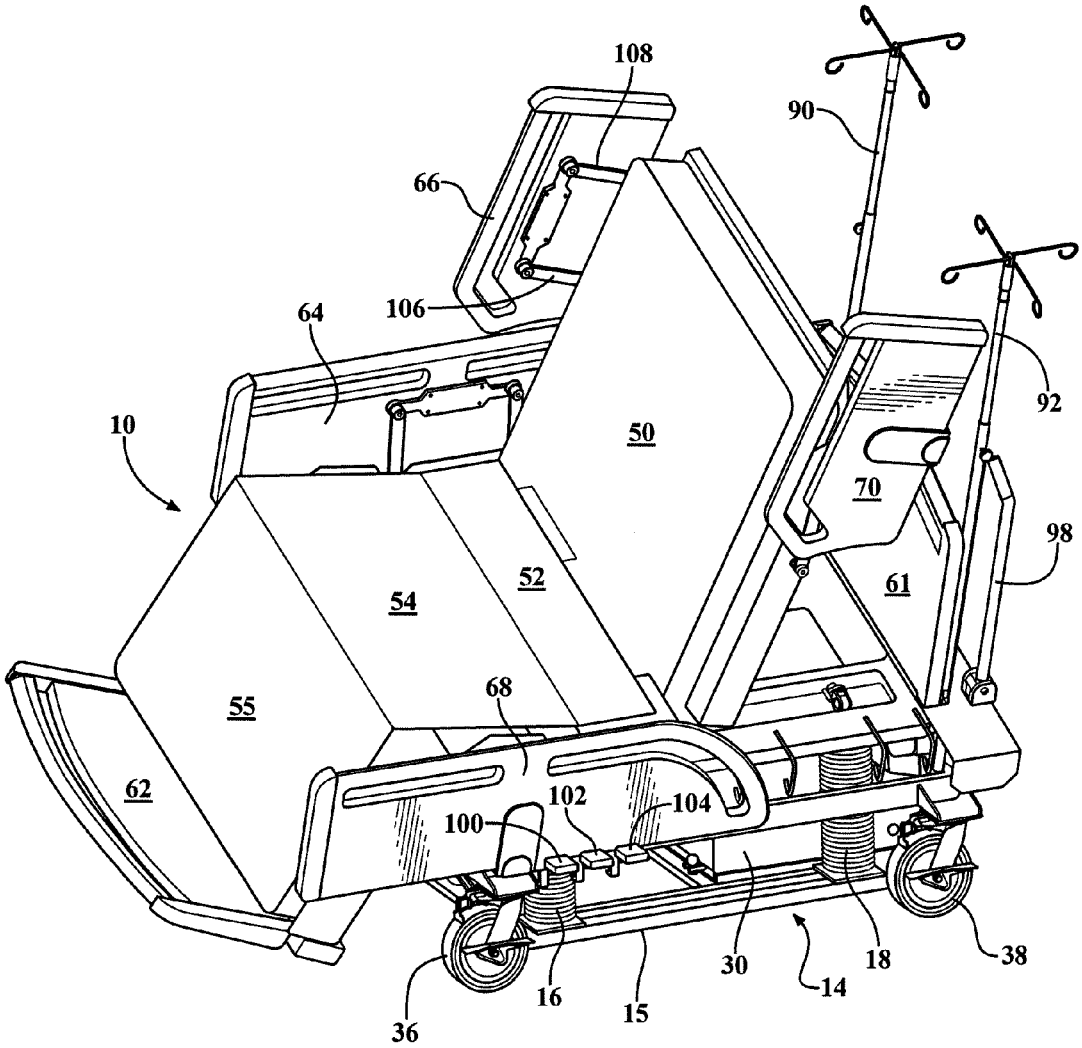
FIG. 13 is a side perspective view of the wheelchair position, corresponding to the forward view of FIG. 12, and illustrates a further progression to that shown in FIG. 9 and by which the leg support portion of the patient support surface is lowered.
Figure 14:
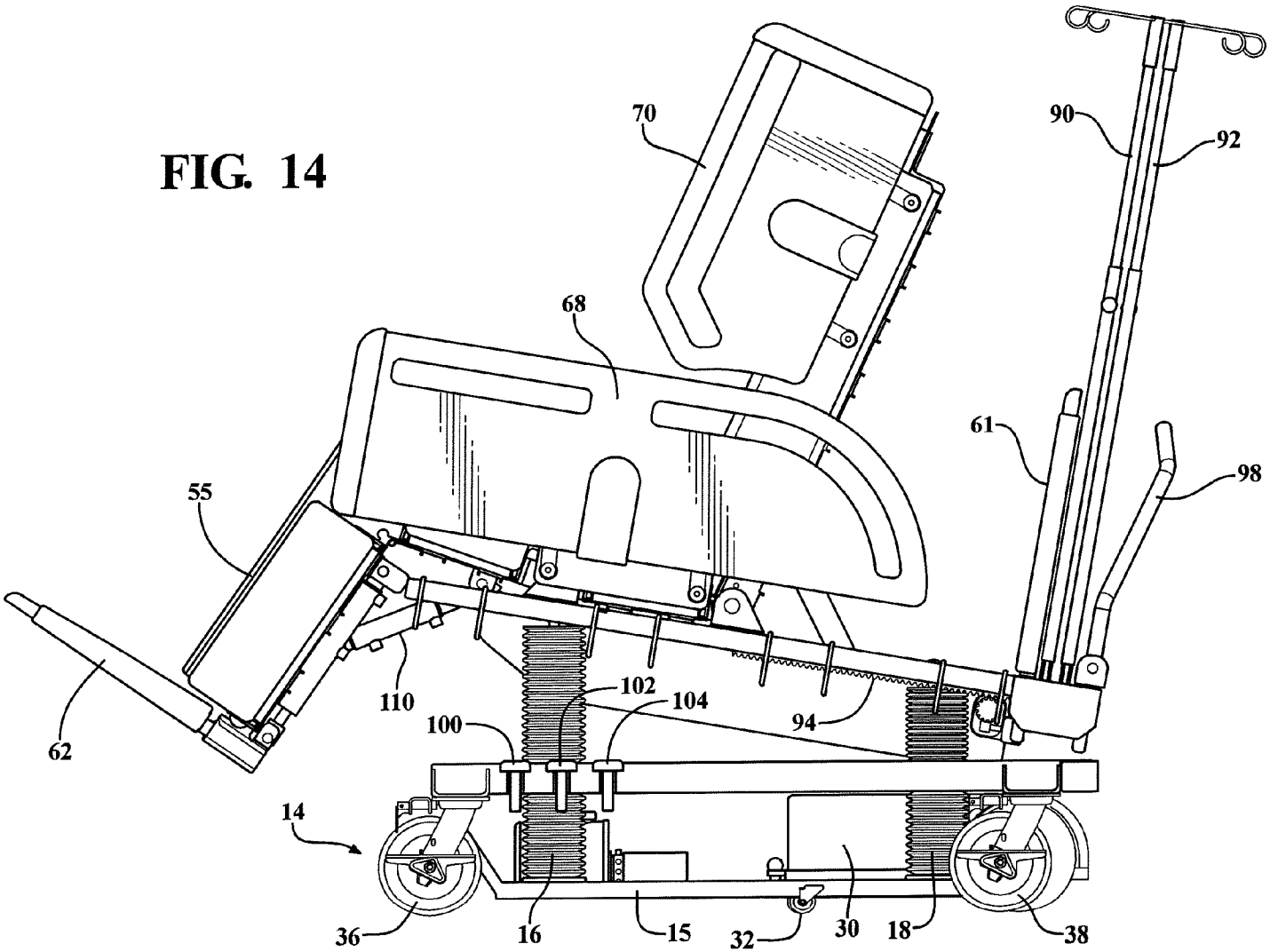
FIG. 14 is a side view of the wheelchair mode substantially as shown in FIG. 13 in a leisure reverse tilt configuration as provided by the plurality of pedestal supporting and individually length/telescopically adjustable supports.

FIG. 13 is a side perspective view of the wheelchair position, corresponding to the forward view of FIG. 12, and illustrates a further progression to that shown in FIG. 9 and by which the leg support portion 54, 55 of the patient support surface is lowered along with the footboard 62 which serves in this configuration as a footrest. FIG. 14 is a side view of the wheelchair mode substantially as shown in FIG. 13 in a leisure reverse tilt configuration as provided by the plurality of pedestal supporting and individually length/telescopically adjustable supports 16, 18, 20 and 22 when actuated by a selected one of the foot pedals 100, 102 and 104.

Figure 15:
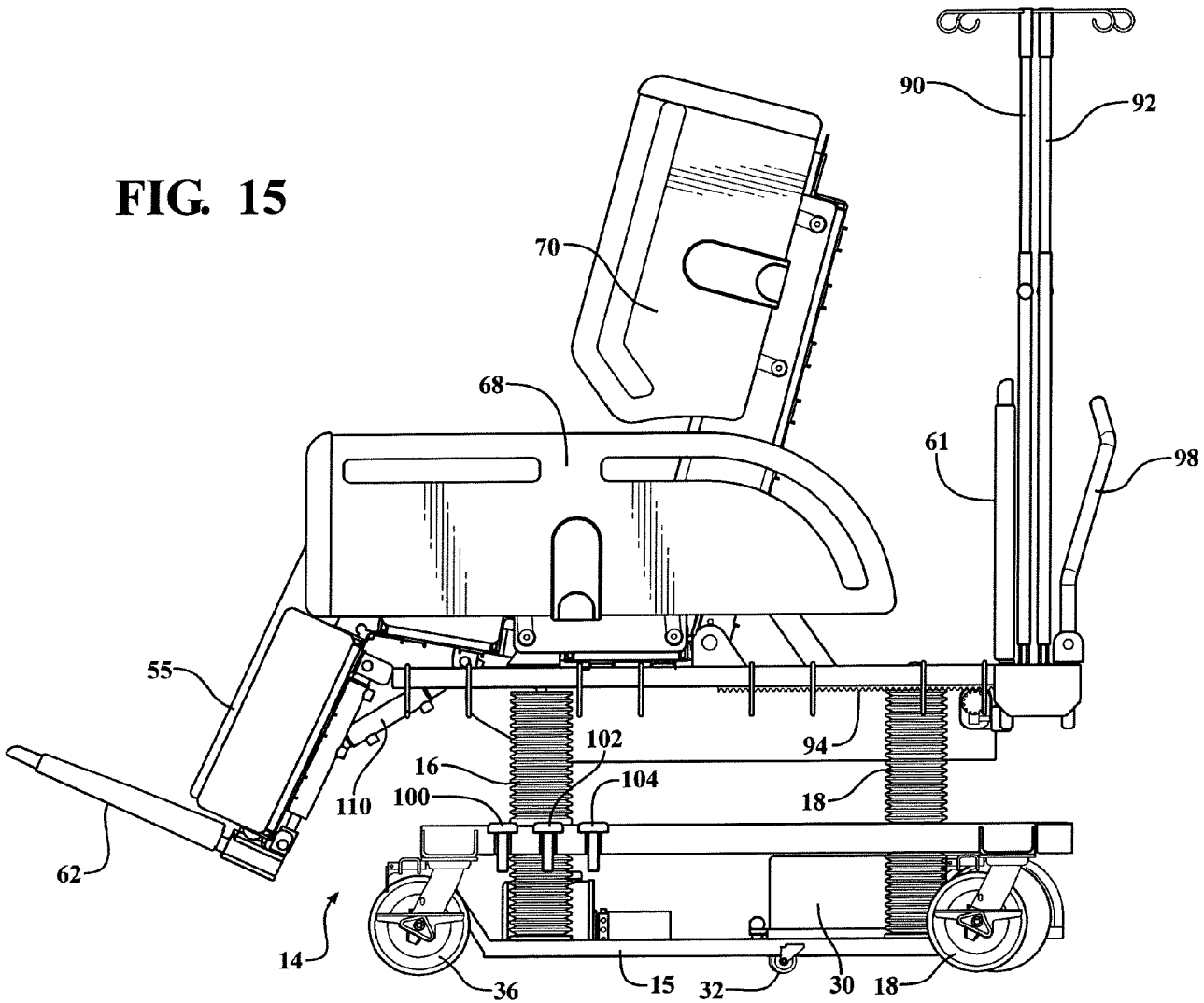
FIG. 15 is a similar illustration to that depicted in FIG. 14 and by which the individually adjustable pedestal supports position the patient (wheelchair position) support surface in a substantially level fashion.

FIG. 15 is a similar illustration to that depicted in FIG. 14 and by which the individually adjustable pedestal supports 100, 102 and 104 are employed to position the patient (wheelchair position) support surface in a substantially level fashion.

Figure 16:
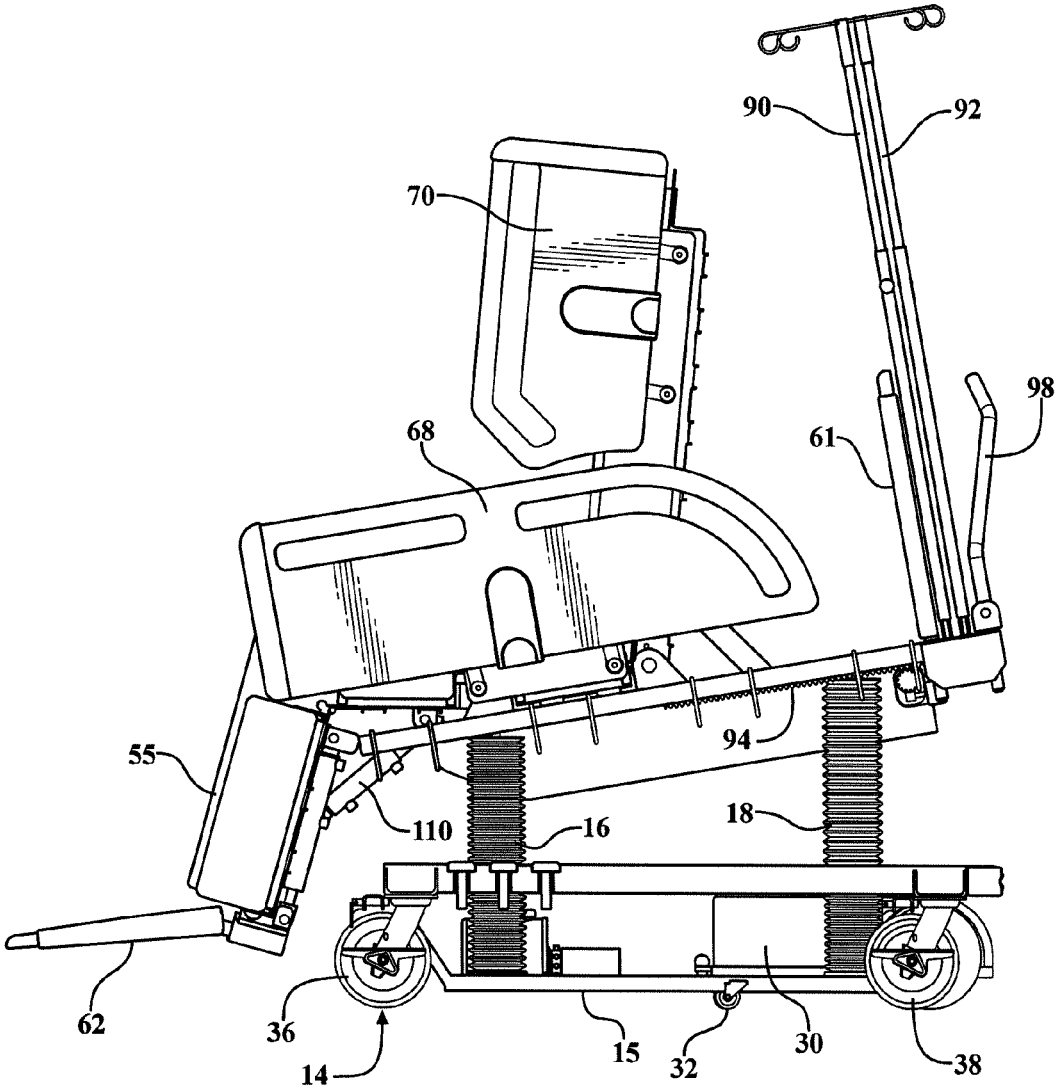
FIG. 16 is a side view of a further wheelchair mode configuration and in which the leg support portion of the patient support surface, in combination with the pedestal supports, are further repositioned to a forwardly tilting/patient egress position.
Figure 17:
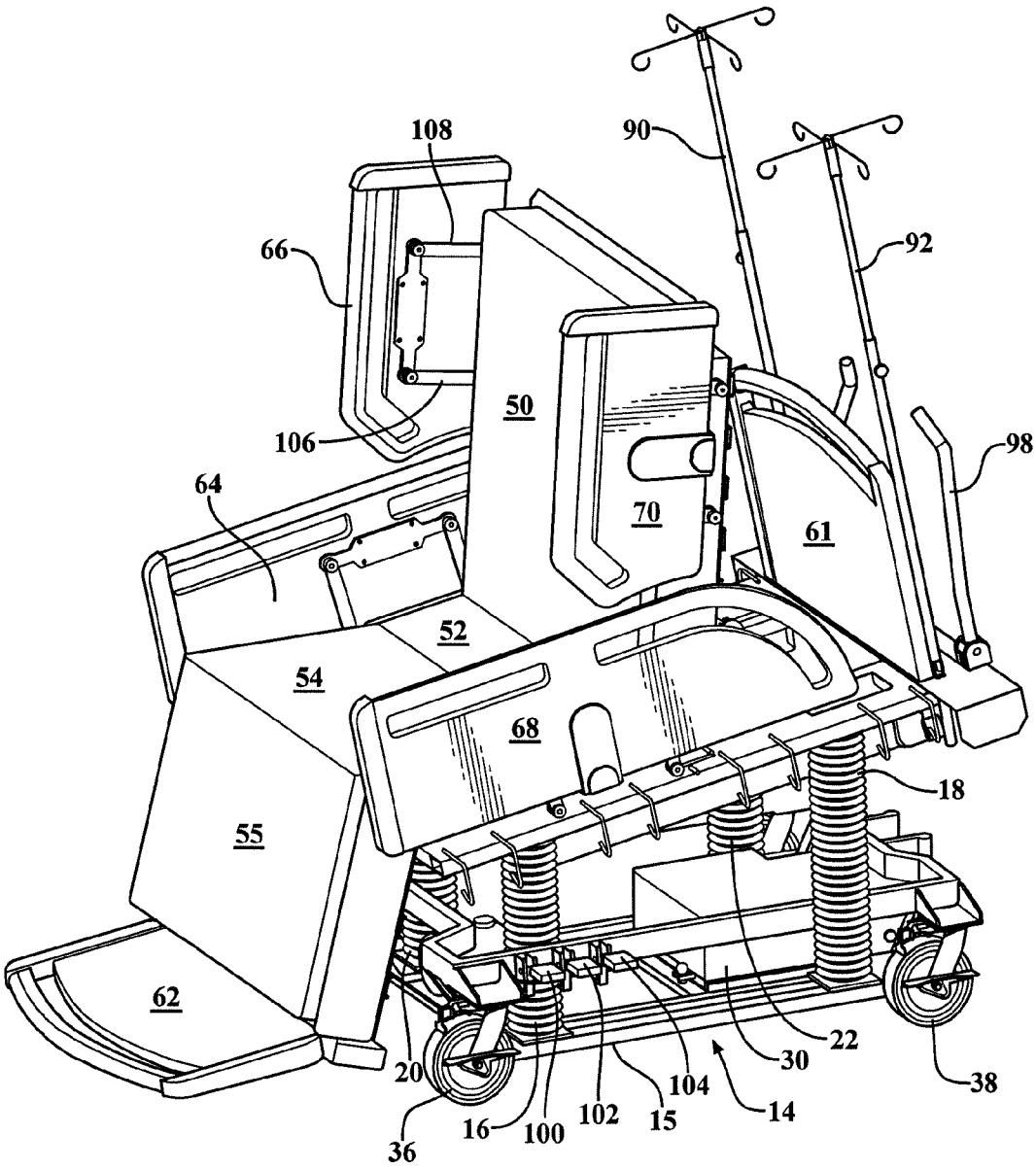
FIG. 17 is a perspective illustration complementing the side view of FIG. 16.

FIG. 16 is a side view of a further wheelchair mode configuration and in which the leg support portions 54 and 55 of the patient support surface, in combination with the pedestal supports, are further repositioned to a forwardly tilting/patient egress assist position, with FIG. 17 providing a perspective illustration complementing the side view of FIG. 16.

Having provided a detailed explanation of the structure and conversion functionality of the assist module 10, headboard module 12 and power support carriage module 14, reference is now made to FIG. 18 which provides an illustration generally at 112 of a further potential configuration of bed support surface and which incorporates a plurality of grid-type surface segments 114 such as which are constructed of individualized and deformable polymeric pockets each filled with a gel type material exhibiting specific viscous properties. The arrangement of the gel pockets are such that they define individual and articulating support locations 114, 116, 118 and 120 of the overall support surface, corresponding to that previously disclosed at 50, 52, 54 and 55 and which cooperate with patient supported pressure points.

As further shown, the underside supporting aspects of the grid shaped gel pockets 114 are such that they exhibit likewise grid shaped and spatially defined longitudinal and articulating locations for facilitating a degree of inter-movement of the pockets in response to forces exerted by the patient. The grid (e.g. rank and file) arrangement of the individual gel pockets 114 further facilitates human contoured support at varying locations associated with the articulating support portions.

Figure 19A:
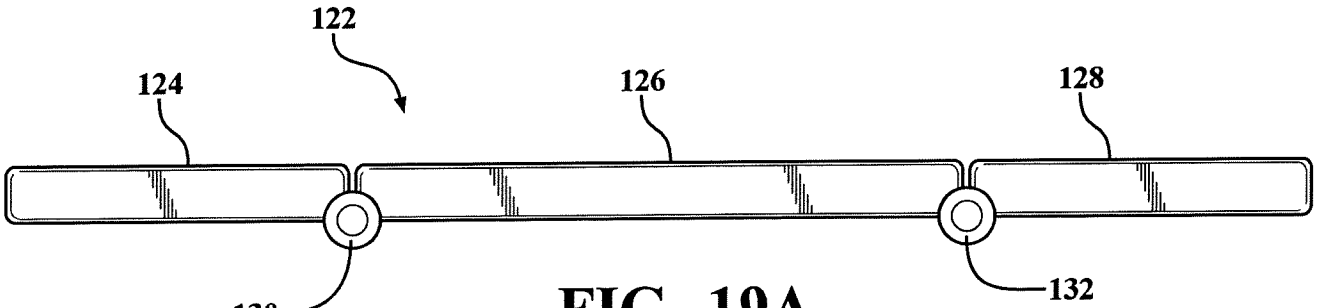
FIGS. 19A and 19B illustrate a pair of level and articulated positions of a patient support surface according to a yet further modification in which the support surface is split, such as either laterally or longitudinally, into three portions to assist in localized patient articulation.
Figure 19B:
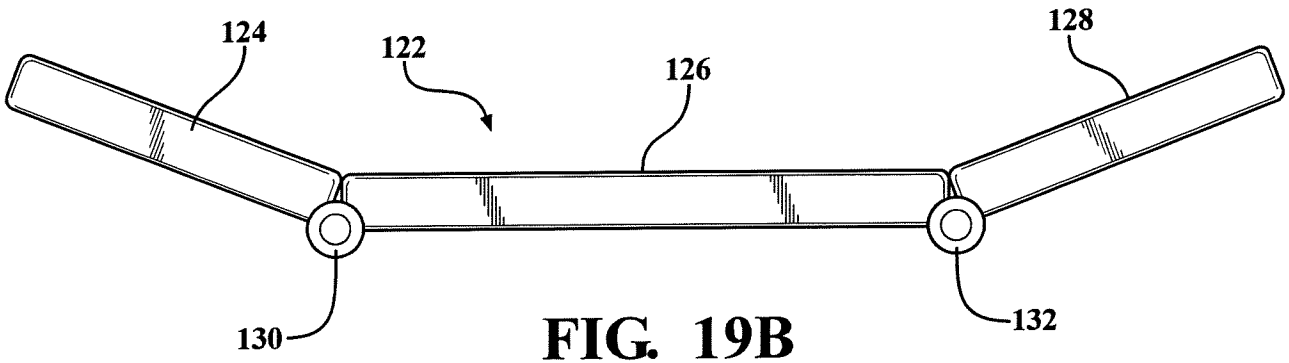

Finally, FIGS. 19A and 19B each generally illustrate at 122 both level and articulated positions of a patient support surface according to a yet further modification. As shown, the support surface can be split either laterally and/or longitudinally into three portions (see at 124, 126 and 128) to again assist in localized patient articulation. In the instance of a longitudinal directed split, the articulating interface of the individual sections would be understood to extend perpendicular to that illustrated by patient support sections 50, 52, 54 and 55 as previously described.

The central width portion 126 and pair of bed side or end extensions 124 and 128 again are contemplated to potentially including both straight (FIG. 19A) and slant (FIG. 19B) end view configurations, the inter-articulating support further being provided by underside situated pivotal interconnections respectively at 130 and 132. As illustrated, the articulating motion of the extensions 124 and 128 relative to the regular width or length defining portion 126 can provide extra comfort to a sleeping patient, as well as assisting the caregiver in repositioning the patient, such as while making the bed or otherwise moving the patient to a side thereof.

In the example illustrated, the patient support surface is divided into three individual and hingedly interconnecting articulating portions (such as associated with head/torso, hip, thigh, knee, etc.). As further previously described, associated side extensions can also be provided for varying an overall width of the articulating support surface.

Additional to that illustrated herein, other potential variants can include a mini-lift system associated with the mobility assist device, and in which a plurality of perimeter located and coordinated lifting points provide for additional therapy induced motion as well as to establish localized lifting of the patient in order to assist the caregiver in performing various tasks. The mini-lift system contemplates opposite side extending and individual pluralities of lift subassemblies each further typically providing up to 50-100 lb of localized lift and in order to assist the caregiver in lifting a patient, such as also for longer durations of time. The ability to provide localized and indefinite lifting more easily allows the accomplishing of such tasks as wound dressing, patient turning, and the like. As with the four vertical post arrangement, it is again understood and envisioned that the individual lift systems can be intercommunicated in a fashion to provide any desired degree of servo induced and reciprocating/recurring motion, such as assisting in therapeutic treatment.

It is also envisioned that other variants of mobility assist power drive units, beyond that generally identified by subset module 14, can be adapted for use with the present invention. Such potential design can provide a telescoping handle extending from a location of a main and wheel supported body of the mobility assist drive unit and which terminates in such as a joystick based steering control. Other features may include an upper directed docking mechanism as well as forward directed steering wheel/mechanism provided for engaging the power assist unit to the underside location of the convertible patient support module.

The present invention contemplates a family of mobility assist power units of various sizes and shaped, these additionally exhibiting a variant of docking technologies including but not limited to vacuum/suction engagement with the patient transport module, magnetic engagement, and the use of mechanical hooks and receiving slots established between the power assist and transport modules. It is also envisioned and understood that the parts associated with such a power assist module can be purchased off of the shelf and simply docked to any manual wheelchair, bed, gurney, stretcher, surgery table, medical equipment table or the like. Additional contemplated variants include those used for any non-hospital or even non-medical applications, or to provide any desired power propulsion (push or pull) of any type of wheeled systems.

Having described our invention, other and additional preferred embodiments will become apparent to those skilled in the art to which it pertains, and without deviating from the scope of the appended claims.

We claim:

1. A mobility assist assembly, comprising:

a patient supporting and transportable module exhibiting an articulating frame with a support surface, a plurality of height adjustable supports engaging underside locations of said articulating frame to tilt said support surface according to at least one of fore, aft and side directions;

a headboard docking module engageable with said patient support module, said headboard module including a built-in power supply and having castors for optionally transporting along with said patient support module; and said support surface further comprising first and second width extension components pivotally supported upon said headboard docking module and displacing into contact with opposite side edges of said support surface.

2. The assembly as described in claim 1, said articulating frame further comprising a plurality of individual articulating sections collectively defining a patient support surface.

3. The assembly as described in claim 1, further comprising a power assist module incorporated into a lower carriage housing associated with said patient support module.

4. The assembly as described in claim 2, said patient support surface further comprising an upper torso supporting portion, an intermediate and pivotally interconnecting midsection/buttock supporting portion, and lower articulating leg support portions.

5. The assembly as described in claim 1, further comprising a winch mechanism extending from said headboard docking module and engaging said mobility assist assembly for drawing into contact with said headboard module.

6. The assembly as described in claim 3, said height adjustable supports further comprising a plurality of four telescoping members supported upon said carriage, each of said telescoping member exhibiting a universal pivot secured to an underside of said articulating frame.

7. The assembly as described in claim 6, further comprising a plurality of foot pedals associated with said carriage for selectively actuation some or all of said telescoping members via at least one power servo drive incorporated into at least one of said patient transport and power assist modules.

8. The assembly as described in claim 3, said power assist module further comprising a power drive component integrated with or releasably attachable to said carriage, said drive component housing a rechargeable battery for generating a power output drive to initial drive wheels positioned in underside ground engaging and proximate fashion to said drive component, the driving force exerted by said drive wheels transferred to additional wheels arranged at corners of said carriage.

9. The assembly as described in claim 1, further comprising a plurality of side rails associated with first and second sides of said patient supporting and transportable module, each of said side rails further comprising pivot brackets for configuring between first and second positions.

10. The assembly as described in claim 1, further comprising a horizontally displaceable headboard separate from said headboard docking module and affixed to a forward end of said patient supporting and transportable module, a footboard pivotally secured to a rearward end of said patient module.

11. The assembly as described in claim 1, said articulating frame configuring between a first bed mode, a second transitioning mode and a third reconfigured wheelchair mode.

12. The assembly as described in claim 1, further comprising said width extending components each being articulated and segmented along with said support surface to facilitate subsequent adjustment to any of a number of different configurations while docked to said headboard module.

13. The assembly as described in claim 1, said support surface further comprising a plurality of grid-type individualized and deformable polymeric pockets.

14. A mobility assist assembly, comprising:

a patient supporting and transportable module exhibiting an articulating frame with a support surface, said articulating frame configuring between a first bed mode, a second transitioning mode and a third wheelchair mode;

a power assist module incorporated into a lower carriage associated with said patient support module and integrating a plurality of height adjustable supports engaging underside locations of said articulating frame to tilt said support surface according to at least one of fore, aft and side directions;

a headboard docking module interfacing with said patient support and power assist modules for providing at least recharging of a battery associated with a drive unit incorporated into said power assist module;

said support surface further comprising an upper torso supporting portion, an intermediate and pivotally interconnecting midsection/buttock supporting portion, and lower articulating leg support portions; and said support surface further having first and second width extension components pivotally supported upon said headboard module and displacing into contact with opposite side edges of said support surface.

15. The assembly as described in claim 14, further comprising a plurality of side rails associated with first and second sides of said patient supporting and transportable module, each of said side rails further comprising pivot brackets for configuring between first and second positions.

16. The assembly as described in claim 14, further comprising a horizontally displaceable headboard affixed to a forward end of said patient supporting and transportable module and a footboard pivotally secured to a rearward end.

* * * * *